US009452601B2

(12) United States Patent
Izume

(10) Patent No.: US 9,452,601 B2
(45) Date of Patent: Sep. 27, 2016

(54) PRINTING PLATE UNIT, PLATE CYLINDER APPARATUS FOR PRINTER, AND PRINTING PLATE UNIT AUTOMATIC MOUNTING APPARATUS

(71) Applicant: I. MER CO., LTD., Kyoto-shi (JP)

(72) Inventor: Masayuki Izume, Kyoto (JP)

(73) Assignee: I. MER CO., LTD., Kyoto-Shi (JP)

( * ) Notice: Subject to any disclaimer, the term of this patent is extended or adjusted under 35 U.S.C. 154(b) by 0 days.

(21) Appl. No.: 14/781,564

(22) PCT Filed: Sep. 4, 2014

(86) PCT No.: PCT/JP2014/073274

§ 371 (c)(1),
(2) Date: Sep. 30, 2015

(87) PCT Pub. No.: WO2015/033987

PCT Pub. Date: Mar. 12, 2015

(65) Prior Publication Data

US 2016/0059543 A1 Mar. 3, 2016

(30) Foreign Application Priority Data

Sep. 4, 2013 (JP) ..... 2013-183009

(51) Int. Cl.

| | |
|---|---|
| ***B41F 27/00*** | (2006.01) |
| ***B41F 27/06*** | (2006.01) |
| ***B41F 27/12*** | (2006.01) |

(52) U.S. Cl.
CPC ..... *B41F 27/06* (2013.01); *B41F 27/1231* (2013.01); *B41F 27/1237* (2013.01)

(58) Field of Classification Search
CPC ..... B41F 27/06; B41F 27/10; B41F 27/105; B41F 27/1237; B41F 27/1243; B41F 27/00; B41F 27/1218; B41F 27/1231; B41F 27/1281; B41F 27/12; B41P 2227/20
See application file for complete search history.

(56) References Cited

U.S. PATENT DOCUMENTS 2,320,762 A * 6/1943 Tollison ..... B41F 27/10 101/378
2011/0120332 A1* 5/2011 Izume ..... B41F 27/105 101/382.1

FOREIGN PATENT DOCUMENTS

DE 2555037 A1 * 6/1977

* cited by examiner

*Primary Examiner* — Matthew G Marini
(74) *Attorney, Agent, or Firm* — Mori & Ward, LLP

(57) ABSTRACT

A printing plate unit automatic mounting apparatus 81 includes: a pressing member 96 inserted from a pressing member insertion opening 33 and pressing an inner slider 36 against a biasing force applied by a printing plate coupling member biasing apparatus 35, a retaining means 94 configured to retain and release the printing plate unit 1 by retaining and releasing a projecting portion 11*a* provided on the printing plate unit 1 and configured to serve as a gripping portion; and a drive apparatus 92 configured to move the retaining means 94 in an axial direction of a plate drive shaft.

16 Claims, 17 Drawing Sheets

PRINTING PLATE UNIT, PLATE CYLINDER APPARATUS FOR PRINTER, AND PRINTING PLATE UNIT AUTOMATIC MOUNTING APPARATUS

TECHNICAL FIELD

The present invention relates to a printing plate unit, a plate cylinder apparatus for a printer, and a printing plate unit automatic mounting apparatus.

BACKGROUND ART

Examples of known printers include a configuration in which a printing plate is mounted on an outer periphery of a plate cylinder to be fixed to a plate drive shaft.

In the printer as described above, a sheet-type printing plate is mounted by winding around a plate cylinder in a state of fixed to the plate drive shaft. In such a case, amounting work of a printing plate in the printer is troublesome, and it is difficult to mount reliably the printing plate to the plate cylinder.

In order to avoid such an event, the plate cylinder may be fixed to the plate drive shaft after a sheet-type printing plate has been mounted by being wound around the plate cylinder in a state of being demounted from the plate drive shaft. In such a case, since the plate cylinder has a significant weight, demounting and mounting operation of the plate cylinder with respect to the plate drive shaft are difficult.

The present inventor proposed a configuration in which a plate portion is provided on part of an outer peripheral surface of a plate body formed of a resilient member (for example, a metallic sheet) into a cylindrical shape and an engaging portion extending axially so as to project inward on an inner periphery of the plate body as a printing plate which can be mounted easily and accurately to a printer (See Patent Literature 1).

This printing plate is used by being mounted on a printing plate mounting portion of a plate cylinder apparatus of the printer. For example, the printing plate mounting portion is provided with a plate cylinder portion provided fixedly on a plate drive shaft, and the printing plate is fitted to the plate cylinder portion from one end side. The printing plate can be mounted accurately and easily at a predetermined position of the plate cylinder by providing the plate cylinder portion with a circumference direction positioning groove in which the engaging portion of the printing plate is fitted from the one end side and an axial direction positioning stopper to which an end portion of the printing plate abuts on an outer periphery thereof. The printing plate can be demounted easily from one end side of the plate cylinder portion.

CITATION LIST

Patent Literature

PTL 1: JP-A-2009-285861

DISCLOSURE OF INVENTION

Technical Problem

The printing plate can be used repeatedly, and the printing plate after usage is demounted from the plate cylinder portion for storage. However, the printing plate described above is formed into a cylindrical shape in advance, and hence requires a relatively large space for storage.

In the printer described above, automation (unmanned operation) is difficult, and mounting of the printing plate or the printing plate unit to the printing plate mounting portion is performed manually.

An object of the present invention is to solve the above-described problem, and provide a printing plate unit having such advantages that a printing plate can be mounted to a printer easily and accurately and no large storage space is required and, in addition, the printing plate can be easily mounted automatically to the printing plate mounting portion of the plate cylinder apparatus for a printer, and a plate cylinder apparatus for a printer provided with the printing plate unit.

It is another object of the invention to provide a printing plate unit automatic mounting apparatus capable of automating mounting of the printing plate unit.

Solution to Problem

A printing plate unit of the present invention is a printing plate unit including: a printing plate having a plate portion provided on part of a front surface of a sheet formed of a resilient material and engaging projecting ridges projecting on a rear surface side or a front surface side at both end portions in a longitudinal direction and extending in a width direction; and a printing plate coupling member coupling both end portions of the printing plate formed cylindrically in the longitudinal direction by engaging the both engaging projecting ridges of the printing plate formed cylindrically, and mounted and demounted with respect to a printing plate mounting portion of a plate cylinder, characterized in that the printing plate coupling member is provided with a projecting portion projecting from the printing plate formed cylindrically in the axial direction and configured to be used as a gripping portion when being mounted and demounted with respect to the printing plate mounting portion.

In this specification, the term "front surface" of a sheet which constitutes part of the printing plate corresponds to a surface which faces radially outside when being formed into a cylindrical shape, and term "rear surface" corresponds to the same to a surface which faces radially inside respectively. The term "longitudinal direction" of the sheet corresponds to a circumferential direction when being formed into the cylindrical shape, and the term "width direction" corresponds to the same axial direction, respectively.

Both end portions of the printing plate formed into a cylindrical shape are coupled to each other by the printing plate coupling member, the printing plate is retained in a cylindrical shape (cylindrically). Since the both end portions of the printing plate formed cylindrically are fixed to the printing plate coupling member in a state in which the engaging projecting ridges engages the printing plate coupling member, the printing plate formed cylindrically does not come apart from the printing plate coupling member even when the printing plate formed cylindrically is pulled.

Assuming that an angle formed between the engaging projecting ridge and a portion of the sheet adjacent thereto is a projecting angle of the engaging projecting ridge, the projecting angle is preferably smaller than 90 degrees in terms of the strength of engagement between the printing plate and the printing plate coupling member. Furthermore, the projecting angle of the engaging projecting ridge is preferably from 35 to 55 degrees and, more preferably, 45 degrees.

For example, the engaging projecting ridges are formed integrally with the sheet by folding respective end portions of a plate-shaped sheet on the rear surface side or the front surface side.

The printing plate which constitutes part of the printing plate unit according to the invention is used by being mounted on a printing plate mounting portion of a plate cylinder apparatus of the printer. For example, the printing plate mounting portion is provided with a printing plate coupling member which constitutes the printing plate unit and a plate cylinder portion provided fixedly on a plate drive shaft of the printer. The printing plate unit is fitted to the plate cylinder portion from one end side, and is demounted from the same one end side. Part of the printing plate is brought into tight contact with an outer peripheral surface of the plate cylinder portion by the printing plate coupling member biased radially outward after the printing plate unit is fitted to the plate cylinder portion. Mounting and demounting of the printing plate unit with respect to the plate cylinder portion is performed in a state in which the printing plate coupling member is not biased radially outward. At this time, the printing plate which constitutes part of the printing plate unit is retained in a cylindrical shape by the printing plate coupling member, so that mounting and demounting of the printing plate unit with respect to the plate cylinder portion is easily achieved. In addition, the printing plate coupling member can be used as a guide at the time of mounting and demounting.

When the printing plate unit is not used, the printing plate coupling member is demounted from the printing plate, and the printing plate can be stored in a plate shape. Therefore, a large space is not required for storing the printing plate.

Since the projecting portion which projects axially from the cylindrical printing plate (the printing plate formed cylindrically) and serves as the gripping portion is provided with the printing plate coupling member when being mounted and demounted with respect to the printing plate mounting portion, the projecting portion can be held easily by a robot arm or the like, and is advantageous for performing automatic mounting of the printing plate unit.

The directions of projection of the both engaging projecting ridges of the printing plate may either be the same or opposite. For example, the both engaging projecting ridges project on the rear surface side of the sheet.

For example, the printing plate coupling member is provided with an inner clamping member and an outer clamping member configured to clamp the both end portions of the cylindrical printing plate in the longitudinal direction from both inside and outside in the radial direction.

The projecting portion which serves as a gripping portion is provided preferably on the inner clamping member. In other words, the axial length of the outer clamping member is the same as the axial length of the cylindrical printing plate, the axial length of the inner clamping member is larger than the axial length of the outer clamping member, and the projecting portion of the inner clamping member exists on a distal end side in the axial direction of the drive shaft when the both clamping members are overlapped with each other.

In the case where the both engaging projecting ridges of the printing plate project on the rear surface side, the both engaging projecting ridges engage the inner clamping member. In the case where the both engaging projecting ridges of the printing plate project on the front surface side, the both engaging projecting ridges engage the outer clamping member. In the case where the directions of projection of the both engaging projecting ridges of the printing plate are opposite from each other, the engaging projecting ridge projecting on the rear surface side engages the inner clamping member, and the engaging projecting ridge projecting on the front surface side engages the outer clamping member respectively.

In this case, the both end portions of the printing plate are clamped by the both clamping members in a state in which the engaging projecting ridges at the respective end portions of the printing plate engage the inner clamping member or the outer clamping member, so that the both end portions of the printing plate are reliably fixed to the printing plate coupling member.

The clamping member that engages the engaging projecting ridge of the printing plate is provided with an engaging portion. The engaging portion engages, for example, a portion between the engaging projecting ridge and a sheet portion adjacent thereto. In this configuration, the engaging projecting ridge reliably engages the clamping member.

The engaging portion, for example, is formed by forming a groove extending in the axial direction on a surface of the inner clamping member facing radially outward or a surface of the outer clamping member facing radially inward. In this case, a portion between the groove and the surface of the clamping member on which the groove is formed corresponds to the engaging portion.

Preferably, the engaging portion is formed so as to come into tight contact with both of the engaging projecting ridges and the rear surface of the sheet. In this configuration, the both end portions of the printing plate are reliably fixed by a portion between the both inner and outer clamping members.

For example, the inner clamping member is provided with a clamping portion configured to clamp the printing plate and a guided portion extending from the clamping portion radially inward of the cylindrical printing plate.

In this case, the printing plate unit is fitted in the plate cylinder portion from one end side with the guided portion of the inner clamping member used as a guide, and then the guided portion of the inner clamping member is biased radially outward, so that the printing plate can be fixed so as to be kept in tight contact with the outer peripheral surface of the plate cylinder portion.

For example, screw hole formed portions having a predetermined thickness are formed in the radial direction of the cylindrical printing plate at a plurality of positions on the inner clamping member, screw holes having a female screw are formed on the respective screw hole formed portions so as to penetrate the screw hole formed portions in the radial direction, screw insertion through holes which penetrate through the outer clamping member in the radial direction are formed at a plurality of positions on the outer clamping member corresponding to the screw holes, the plurality of clamping screw members are screwed into the screw holes so as to penetrate through the screw insertion through holes from the radially outward, retaining stoppers are provided at a distance radially inward from the screw hole formed portions of the clamping screw members projecting radially inward of the screw holes in a state in which the both clamping members are fixed by the clamping screw members, and permanent magnets are provided on the both clamping members in directions of interacting repulsively.

When the clamping screw members are loosened, the outer clamping member moves away from the inner clamping member by repulsive forces of the permanent magnets. Therefore, the outer clamping member does not have to separate manually from the inner clamping member. In the state in which the both clamping members are apart from each other, the engaging projecting ridges of the respective end portions of the printing plate are engaged by one of the clamping members, and the engaging projecting ridges at the both end portions of the printing plate are fixedly clamped by the both clamping members by tightening the screw members. Then, in the state in which the screw members are loosened and the outer clamping member is kept apart from the inner clamping member, the printing plate is demounted from the clamping members. When the screw members are loosened, and the retaining stoppers provided on the screw members reach the end portions of the screw holes, the screw members cannot be loosened any longer and the inner and outer both clamping members have a state of being mounted to the screw members. Therefore, even in a state in which the printing plate is demounted from the both clamping members, the both clamping members and the screw members are not separated and hence handling is easy.

For example, the inner clamping member includes a clamping portion configured to clamp and fix the printing plate and a guided portion extending from the clamping portion radially inward of the cylindrical printing plate, a plurality of hole-shaped portions penetrating through the guided portion in the circumferential direction of the cylindrical printing plate are formed, and portions radially outward from the hole-shaped portion of the cylindrical printing plate corresponds to the screw hole formed portions.

In this case, portions of the clamping screw members on a distal end side are positioned in hole-shaped portions of the guided portion so as not to stand in the way.

A plate portion is formed of a suitable synthetic resin such as UV cured resin or the like. A printing pattern of the plate portion may be formed by various methods and, for example, is formed of a laser curving. The curving by a laser may be performed through various known methods. Preferably, however, in this case, the curving is performed in a state of a printing plate unit.

In this configuration, a machining accuracy of the plate portion of the printing plate may be enhanced, and printing with high degree of accuracy can be performed.

A plate cylinder apparatus for a printer according to the present invention is a plate cylinder apparatus for a printer including: a printing plate unit; a plate drive shaft; and a printing plate mounting portion for mounting the printing plate unit to the plate drive shaft, wherein the printing plate unit is any one of the above-described printing plate units, the printing plate mounting portion includes a cylindrical plate cylinder portion fixedly provided on the plate drive shaft and allows the printing plate unit to be mounted on an outer periphery thereof from a side of the distal end of the plate drive shaft, the printing plate mounting portion includes: a printing plate coupling member accommodating groove configured to accommodate the printing plate coupling member of the printing plate unit from a side of the distal end of the plate drive shaft, an axial direction positioning stopper portion to which a proximal end portion of the plate drive shaft of the printing plate coupling member configured to abut, a printing plate coupling member guiding portion configured to guide the printing plate coupling member so as to be movable within a predetermined range in the radial direction of the plate cylinder portion, and a printing plate coupling member biasing apparatus configured to bias the printing plate coupling member radially outward of the plate cylinder portion.

As described above, the both end portions of the printing plate are coupled to each other by the printing plate coupling member, and the printing plate is held in a cylindrical shape, so that the printing plate unit used in the plate cylinder apparatus for a printer according to the present invention is configured.

An inner diameter of the printing plate in the printing plate unit formed into a cylindrical shape is slightly larger than the outer diameter of the plate cylinder portion.

The printing plate is mounted on the printing plate mounting portion in a state of being formed into the printing plate unit. When mounting the printing plate unit on the printing plate mounting portion, the printing plate coupling member biasing apparatus is in a state in which the printing plate coupling member biasing apparatus does not bias the printing plate coupling member radially outward. In this state, the printing plate unit is fitted into the plate cylinder portion from one end side so that the printing plate coupling member is fitted in a printing plate coupling member accommodating groove, and a proximal end portion of the printing plate coupling member is brought into abutment with the axial direction positioning stopper. Accordingly, the printing plate is mounted to a predetermined position of the plate cylinder portion accurately and easily. Since the inner diameter of the printing plate formed into a cylindrical shape is slightly larger than the outer diameter of the plate cylinder portion and the printing plate coupling member biasing apparatus is in a state of not biasing the printing plate coupling member radially outwardly, when the printing plate is mounted, a gap exists between the outer peripheral surface of the plate cylinder portion and the printing plate, whereby the printing plate can be mounted easily to the plate cylinder portion. When the printing plate is mounted, the printing plate coupling member biasing apparatus is brought into a state of biasing the printing plate coupling member radially outward, and the printing plate can be fixed so as to be kept in tight contact with the outer peripheral surface of the plate cylinder portion. In this manner, the printing plate coupling member of the printing plate unit is fitted in the printing plate coupling member accommodating groove of the plate cylinder portion, the proximal end portion of the printing plate coupling member is in abutment with the axial direction positioning stopper portion, and the printing plate coupling member biasing apparatus brings the printing plate into tight contact with the outer peripheral surface of the plate cylinder portion, so that the printing plate is positioned in the circumferential direction and the axial direction, and a positional misalignment of the printing plate with respect to the plate cylinder portion during use is avoided.

When demounting the printing plate from the printing plate mounting portion, the printing plate coupling member biasing apparatus is in a state in which the printing plate coupling member biasing apparatus does not bias the printing plate coupling member radially outward. Accordingly, a gap is generated between the outer peripheral surface of the plate cylinder portion and the printing plate, so that the printing plate unit can be demounted easily from the one end side of the plate cylinder portion by being moved in the axial direction.

A difference between the inner diameter of the printing plate when being formed into a cylindrical shape and the outer diameter of the outer peripheral surface of the plate cylinder portion is preferably as small as possible within a range which allows the printing plate unit to be mounted and demounted easily with respect to the plate cylinder portion.

For example, a depression configured to avoid interference between a printing plate unit retaining apparatus configured to retain the printing plate unit and the plate cylinder portion at the time of mounting and demounting of the printing plate unit (interference preventing depression) is provided at a position radially opposing the printing plate coupling member accommodating groove at an end portion of a distal end of the plate drive shaft of the plate cylinder portion.

When performing automatic mounting of the printing plate unit, the printing plate unit retaining apparatus configured to retain the printing plate unit is configured to retain the projecting portion of the printing plate coupling member projecting from the cylindrical printing plate in the axial direction and retain a portion of the printing plate radially opposing the projecting portion. In this case, there is a probability that the printing plate unit retaining apparatus and the plate cylinder portion interfere with each other, and the provision of the depressions for avoiding the interference on the plate cylinder portion is advantageous for performing an automatic mounting of the printing plate unit.

The directions of projection of the both engaging projecting ridges of the printing plate may either be the same or opposite. Preferably, the both engaging projecting ridges project on the rear surface side of the sheet.

For example, the printing plate coupling member accommodating groove is formed on a groove formed surface provided on the outer periphery of the plate cylinder portion, the axial direction positioning stopper portion is provided at a proximal end portion of the plate drive shaft of the printing plate accommodating groove, the printing plate coupling member guiding portion is provided in the printing plate coupling member accommodating groove, and at least part of the printing plate coupling member biasing apparatus is provided at a biasing apparatus accommodating depression formed on a bottom of the printing plate coupling member accommodating groove.

For example, the groove formed surface is formed by removing part of an outer peripheral cylindrical surface of the plate cylinder portion. The groove formed surface may be a curved surface, but preferably is a flat surface.

In a state in which the printing plate unit is mounted on the plate cylinder portion, and the printing plate is brought into tight contact with an outer peripheral surface of the plate cylinder portion by the printing plate coupling member biasing apparatus, a dimensional relationship between the plate cylinder portion and printing plate unit is determined so that the printing plate coupling member does not protrude radially outward from an virtual cylindrical surface including the outer peripheral surface of the plate cylinder portion. Such a dimensional relationship is achieved by the groove formed surface formed by removing part of the outer peripheral cylindrical surface of the plate cylinder portion.

For example, the printing plate coupling member includes an inner clamping member and an outer clamping member configured to clamp the both end portions of the cylindrical printing plate in the longitudinal direction from both inside and outside in the radial direction.

In this case, the both end portions of the printing plate are clamped by the both clamping members in a state in which the engaging projecting ridges at the respective end portions of the printing plate engage the inner clamping member or the outer clamping member, so that the both end portions of the printing plate are reliably fixed to the printing plate coupling member.

For example, the inner clamping member corresponds to the guided portion which is guided by the printing plate coupling member guiding portion when and after the printing plate coupling member is accommodated in the printing plate coupling member accommodating groove, and is configured to be biased radially outward of the plate cylinder portion by the printing plate coupling member biasing apparatus.

In this case, the printing plate unit can be fitted in the plate cylinder portion from the one end side easily by the inner clamping member being guided by the printing plate coupling member guiding portion of the plate cylinder portion, and the printing plate coupling member can be moved smoothly in the radial direction. In addition, the printing plate unit is fitted in the plate cylinder portion and then the inner clamping member is biased radially outward by the printing plate coupling member biasing apparatus, so that the printing plate can be fixed reliably so as to be kept in tight contact with the outer peripheral surface of the plate cylinder portion.

For example, the inner clamping member includes a clamping portion configured to fixedly clamp the printing plate and a guided portion extending radially inward of the cylindrical printing plate from the clamping portion and, the guided portion which is guided by the printing plate coupling member guiding portion is biased by the printing plate coupling member biasing apparatus.

In this case, the printing plate unit can be fitted in the plate cylinder portion from one end side easily by the guided portion of the inner clamping member being guided by the printing plate coupling member guiding portion of the plate cylinder portion, and the printing plate coupling member can be moved smoothly in the radial direction. In addition, the printing plate unit is fitted in the plate cylinder portion and then the guided portion of the inner clamping member is biased radially outward by the printing plate coupling member biasing apparatus, so that the printing plate can be fixed reliably so as to be kept in tight contact with the outer peripheral surface of the plate cylinder portion.

For example, a pair of guiding members which extends in the axial direction of the plate cylinder portion and constituting part of the printing plate coupling member guiding portion are provided so as to oppose each other on side walls of the printing plate coupling member accommodating groove opposing in the circumferential direction of the plate cylinder portion, an intermediate portion of the guided portion of the inner clamping member in the radial direction of the plate cylinder portion is interposed between the pair of guiding members so as to slide in the axial direction and the radial direction of the plate cylinder portion, and part of the guided portion of the inner clamping member protruding from the pair of guiding members radially inward of the plate cylinder portion is biased by the printing plate coupling member biasing apparatus.

In this case, a pair of guiding members which constitute part of the printing plate coupling member guiding portion are capable of guiding the guided portion of the inner clamping member reliably and smoothly in the axial direction and the radial direction, and the printing plate coupling member biasing apparatus is capable of biasing the printing plate coupling member reliably from radially inside.

For example, a movement restricting projection configured to prevent the radially outward movement of the inner clamping member by an abutment with the pair of guiding members is provided at a portion of the guided portion of the inner clamping member protruding radially inward of the plate cylinder portion by the pair of guiding members.

When the plate cylinder portion having the printing plate coupling member mounted thereon rotates, the printing plate coupling member makes an attempt to move radially outward by a centrifugal force. However, the movement of the printing plate coupling member is stopped by an abutment of the movement restricting projection with a pair of guiding members, so that the printing plate coupling member is prevented from jumping out from the plate cylinder portion.

For example, the guided portion includes a thick portion having a width larger than other portions at an end portion on a projecting portion side which serves as the gripping portion and a tapered portion having a gradually reducing width at an end portion on a side farther from the projecting portion which serves as the gripping portion and, correspondingly, a wide guided portion fitting groove portion in which the thick portion of the guided portion is fitted without rattling and a narrow guided portion fitting groove portion in which a distal end portion of the guided portion is fitted without rattling are formed between the pair of guide members.

In this case, when mounting the printing plate unit to the printing plate mounting portion, the tapered portion at the distal end of the guided portion enters the wide guided portion fitting groove portion and then a thin portion enters the wide guided portion fitting groove portion. Here, the distal end of the guided portion is tapered and a gap exists between the thin portion of the guided portion and the wide guided portion fitting groove portion, so that insertion of the guided portion into the guided portion fitting groove portions are not hindered even though a slight decentering exists between the guided portion and the guided portion fitting groove portion. Subsequently, the distal end portion of the thin portion of the guided portion fits in the narrow guided portion fitting groove portion without rattling, and the thick portion of the guided portion is fitted to the wide guided portion fitting groove portion without rattling, so that a coupling member is fitted in the printing plate coupling member accommodating groove without rattling and slidably.

For example, the printing plate coupling member biasing apparatus includes an inner slider disposed so as to be capable of sliding over a predetermined range in the axial direction of the plate cylinder portion along a wall of the biasing apparatus accommodating depression, and having a wedge surface facing the distal end side of the plate drive shaft formed at a portion radially outside the plate cylinder portion, an outer slider disposed between the inner slider and the inner clamping member so as to be capable of sliding a predetermined range in the radial direction of the plate cylinder portion along a wall of the biasing apparatus accommodating depression, and provided with a wedge surface facing the proximal end side of the plate drive shaft formed so as to abut with the wedge surface of the inner slider at a portion radially inward of the plate cylinder portion; and a resilient member configured to bias the inner slider toward the distal end of the plate drive shaft, and a pressing member insertion opening which allows insertion of a pressing member configured to move the inner slider toward the proximal end of the plate drive shaft against a biasing force of the resilient member is provided so as to face an end surface of the inner slider on the side of the distal end of the plate drive shaft.

In this case, when the pressing member having an adequate shape (for example a long column shaped member) is inserted from the pressing member insertion opening and moved toward the proximal end of the plate drive shaft, the inner slider is moved toward the proximal end against the biasing force of the resilient member by being pressed by the pressing member, and the wedge surface of the inner slider moves away from the wedge surface of the outer slider, so that the outer slider moves radially inward. In this state, the printing plate unit can be mounted easily on the plate cylinder. When the pressing member is moved toward the distal end of the plate drive shaft after the printing plate is mounted on the plate cylinder, the inner slider moves toward the distal end by the biasing force of the resilient member, and the wedge surface of the inner slider presses the wedge surface of the outer slider radially outward to bias the outer slider radially outward. When the inner slider moves toward the distal end to a predetermined position, the printing plate is pulled by a radially outward biasing force acting on the outer slider, and is fixed to the outer peripheral surface of the plate cylinder portion in a tightly contact manner. Therefore, the outer slider is biased radially outward by the inner slider and the printing plate is in always pulled state. Therefore, even when the printing plate is extended by a change with time, the printing plate is not be loosened during printing.

In this manner, only by adjusting a position of the inner slider in the axial direction by using the pressing member, mounting, demounting and fixation of the printing plate unit can be performed easily with respect to the plate cylinder portion. In addition, the mounted printing plate can be kept in always pulled state to prevent the printing plate from being loosened. Insertion of the pressing member is possible by a manual operation as a matter of course. However, it can be inserted by using a robot or the like easily and insertion of the pressing member may be automated.

For example, the inner slider and a wall of the biasing apparatus accommodating depression are brought into tight contact with each other by a magnetic attracting force of permanent magnets, the outer slider and the wall of the biasing apparatus accommodating depression are brought into tight contact with each other by a magnetic attracting force of the permanent magnets, so that the wedge surfaces of the both inner and outer sliders are in tight contact with each other by a magnetic attracting force of the permanent magnets.

The magnetic attracting force of the permanent magnets is determined to a magnitude which allows a relative movement of the both members in tight contact but prevents a relative separation.

In this case, separation of the both inner and outer sliders from the wall of the biasing apparatus accommodating depression and separation of the wedge surfaces of the both sliders are prevented by a magnetic attraction force of the permanent magnet, and the movements of the both sliders are smooth.

A printing plate unit automatic mounting apparatus of the first invention is a printing plate unit automatic mounting apparatus for mounting and demounting a printing plate unit in a plate cylinder apparatus for a printer with respect to the printing plate mounting portion including: a biasing apparatus pressing apparatus capable of moving between a normal position not working against a biasing force applied by the printing plate coupling member biasing apparatus and an operating position for applying a counter biasing force with respect to the biasing force applied by the printing plate coupling member biasing apparatus; a printing plate unit retaining apparatus configured to retain and release the printing plate unit by retaining and releasing a projecting portion provided on the printing plate unit and configured to serve as the gripping portion; and a retaining apparatus moving apparatus configured to move the printing plate unit retaining apparatus in the axial direction of the plate drive shaft.

According to this printing plate unit automatic mounting apparatus, first, the printing plate unit is retained by the printing plate unit retaining apparatus, subsequently, the biasing apparatus pressing apparatus is moved to an operating position to apply a counter biasing force with respect to the biasing force of the printing plate coupling member biasing apparatus and eliminating a biasing function by the printing plate coupling member biasing apparatus, subsequently, the printing plate unit retaining apparatus is moved toward the axially proximal end of the plate drive shaft by a retaining apparatus moving apparatus until the printing plate unit reaches a position where the printing plate unit is mounted on the plate cylinder portion, and subsequently, the biasing apparatus pressing apparatus is moved to the normal position. Accordingly, the printing plate coupling member is biased radially outwardly of the plate cylinder portion and the printing plate unit is brought into tight contact with the plate cylinder portion. In this state, retention of the printing plate unit by the printing plate unit retaining apparatus is released and the retaining apparatus moving apparatus is moved to an axially distal end side of the plate drive shaft (the direction away from the plate cylinder portion), so that the printing plate unit mounting operation is completed. In this manner, the printing plate unit may be mounted and demounted automatically with respect to the printing plate mounting portion.

A biasing member pressing apparatus includes for example, a pressing member being inserted from the pressing member insertion opening and pressing the inner slider against a biasing force applied by the printing plate coupling member biasing apparatus, and a moving apparatus configured to move the pressing member.

A printing plate unit automatic mounting apparatus according to the second invention is a printing plate unit automatic mounting apparatus for mounting and demounting a printing plate unit in a plate cylinder apparatus for a printer with respect to a printing plate mounting portion comprising: a pressing member inserted from the pressing member insertion opening and pressing an inner slider against a biasing force applied by the printing plate coupling member biasing apparatus, a printing plate unit retaining apparatus configured to retain and release the printing plate unit by retaining and releasing a projecting portion provided on the printing plate unit and configured to serve as the gripping portion; and a retaining apparatus moving apparatus configured to move the printing plate unit retaining apparatus in the axial direction of the plate drive shaft.

According to this printing plate unit automatic mounting apparatus, first, the printing plate unit is retained by the printing plate unit retaining apparatus, subsequently, the pressing member is moved to be inserted from the pressing member insertion opening into the biasing apparatus accommodating depression to press the inner slider, so that a printing plate coupling member is moved inward against a biasing force of the printing plate coupling member biasing apparatus, subsequently, the printing plate unit retaining apparatus is moved toward the axially proximal side of the plate drive shaft by a retaining apparatus moving apparatus until the printing plate unit reaches a position where the printing plate unit is mounted on the plate cylinder portion, and subsequently, the pressing member is moved to the normal position. Accordingly, the printing plate coupling member is biased radially outward of the plate cylinder portion and the printing plate unit is brought into tight contact with the plate cylinder portion. In this state, retention of the printing plate unit by the printing plate unit retaining apparatus is released and the retaining apparatus moving apparatus is moved to an axially distal end side of the plate drive shaft (the direction away from the plate cylinder portion), so that the printing plate unit mounting operation is completed. In this manner, the printing plate unit may be mounted and demounted automatically with respect to the printing plate mounting portion.

For example, the printing plate unit retaining apparatus includes first retaining means configured to retain and release a projecting portion which serves as the gripping portion, and second retaining means configured to retain and release the end portion on the distal end side of the plate drive shaft of the printing plate of the printing plate unit.

In this case, the printing plate unit can be retained not only by the first retaining means but also by the second retaining means, and the printing plate unit can be retained further stably.

For example, the first retaining means is configured to retain the projecting portion of the inner clamping member from three directions by a first movable claw to be placed at a corner formed by a radially inside surface of the clamping portion and a surface facing one side in the circumferential direction of the guided portion, a second movable claw configured to be placed at a corner formed by a radially inside surface of the clamping portion and a surface facing the other side of the guided portion in the circumferential direction, and a third claw to be placed on a radially outside surface of the clamping portion.

In this case, the retention of the printing plate unit by the first retaining means is ensured.

For example, the second retaining means is configured to retain a portion of the printing plate at a position 180 degrees apart from the coupling member by an inner movable claw facing the printing plate from inside in the radial direction and an outer movable claw opposing the printing plate from the outside in the radial direction.

In this case, the retention of the printing plate unit by the second retaining means which is auxiliary with respect to the first retaining means is also ensured.

Advantageous Effects of Invention

According to the printing plate unit of the invention, mounting and demounting with respect to a printer is easy as described above and, in addition, a projecting portion projecting from the cylindrical printing plate in the axial direction is provided on a printing plate coupling member, it is advantageous for performing automatic mounting of the printing plate unit. The printing plate from which the printing plate coupling member is demounted may be stored in a plate shape, and the printing plate does not require a large space for storage.

According to the plate cylinder apparatus for a printer of the invention as described above, mounting, demounting, and fixation of the printing plate with respect to the printer can be performed easily and accurately and, in addition it is advantageous for performing an automatic mounting of the printing plate unit.

According to a printing plate unit automatic mounting apparatus of the invention as described above, the printing plate unit can be mounted and demounted automatically with respect to the printing plate mounting portion.

Figure 1:
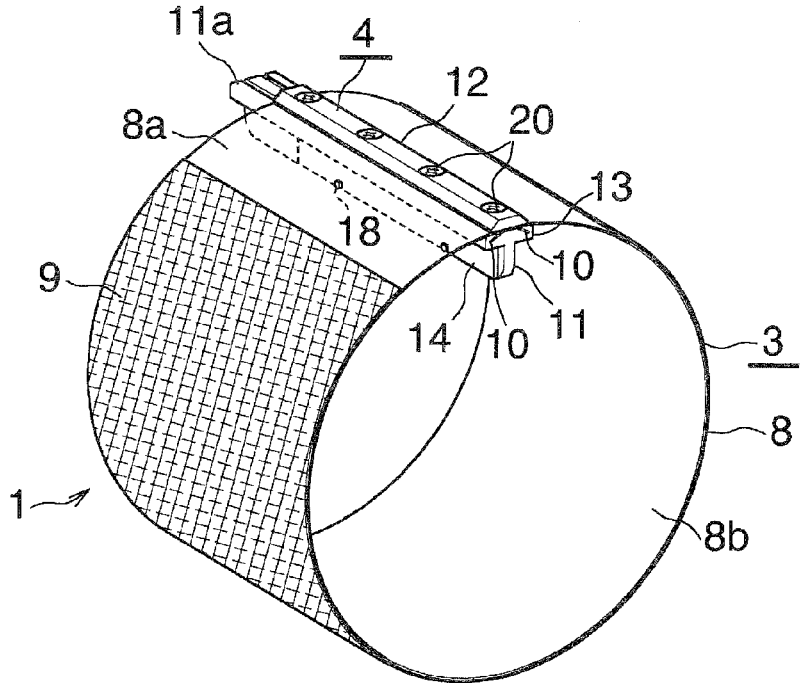
FIG. 1 is a perspective view of a printing plate unit illustrating a first embodiment of the invention.

REFERENCE SIGNS LIST (1): printing plate unit, (2): printing plate mounting portion, (3): printing plate, (4): printing plate coupling member, (5): plate drive shaft, (7): plate cylinder portion, (8): sheet (9): plate portion, (10): engaging projecting ridges, (11): inner clamping member, (11*a*): projecting portion (12): outer clamping member, (13): clamping portion, (14): guided portion, (15): engaging portion, (26): groove formed surface, (28): stopper member (axial direction positioning stopper portion), (29): printing plate coupling member accommodating groove, (30): guiding member (printing plate coupling member guiding portion), (30*a*) (30*b*): guided portion fitting groove portion, (31): biasing apparatus accommodating depression, (33): pressing member insertion opening, (35): printing plate coupling member biasing apparatus, (36): inner slider, (36*a*): wedge surface, (37) outer slider, (37*a*) wedge surface, (38) compressed coil spring (resilient member), (39): interference preventing depression, (40)(41)(43)(44)(61)(62): permanent magnet, (56): hole-shaped portion, (57) screw forming portion, (59): stopper (81): printing plate unit automatic mounting apparatus, (92): driving apparatus (retaining apparatus moving apparatus), (94); first retaining means (printing plate unit retaining apparatus), (95): second retaining means (printing plate retaining apparatus), (96): pressing member

DESCRIPTION OF EMBODIMENTS

Referring now to the drawings, some embodiments of the present invention will be described below.

Figure 2:
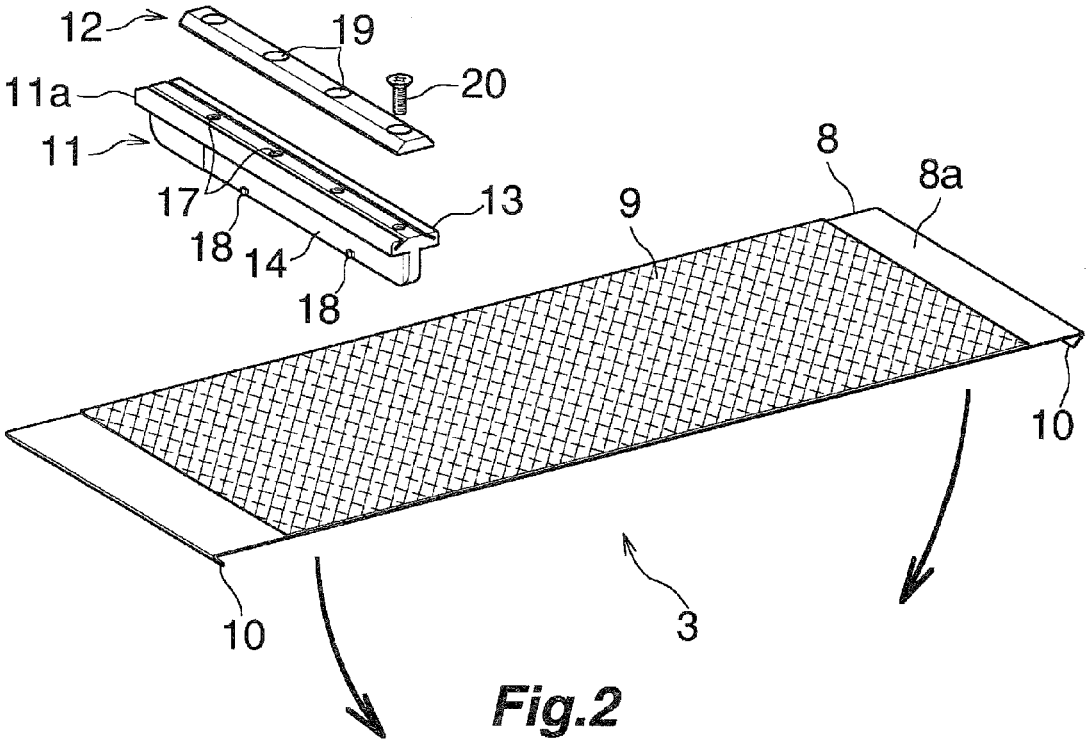
FIG. 2 is an exploded perspective view of the same printing plate unit.
Figure 3:
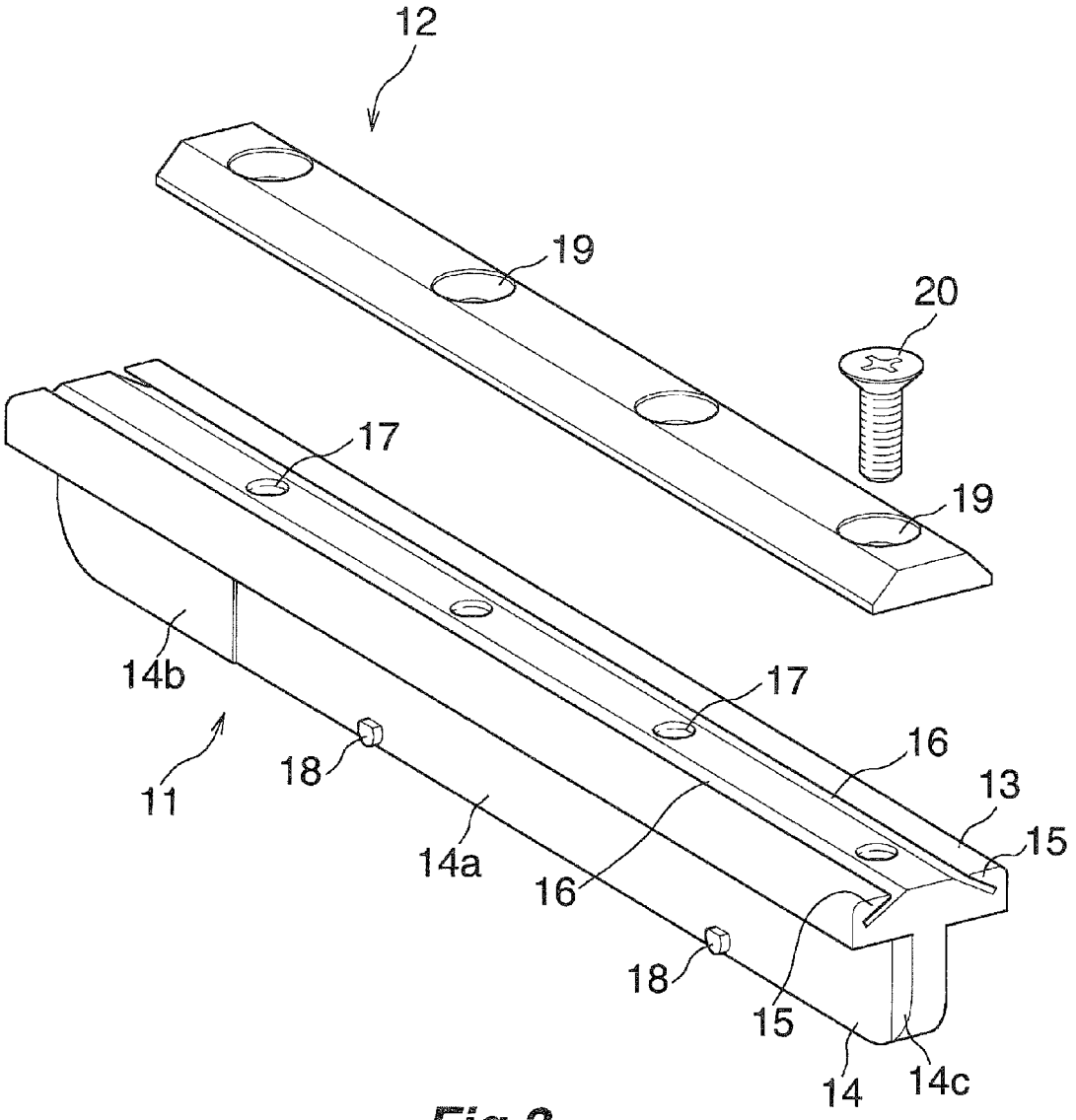
FIG. 3 is an exploded perspective view of a printing plate coupling member of the same printing plate unit.
Figure 9:
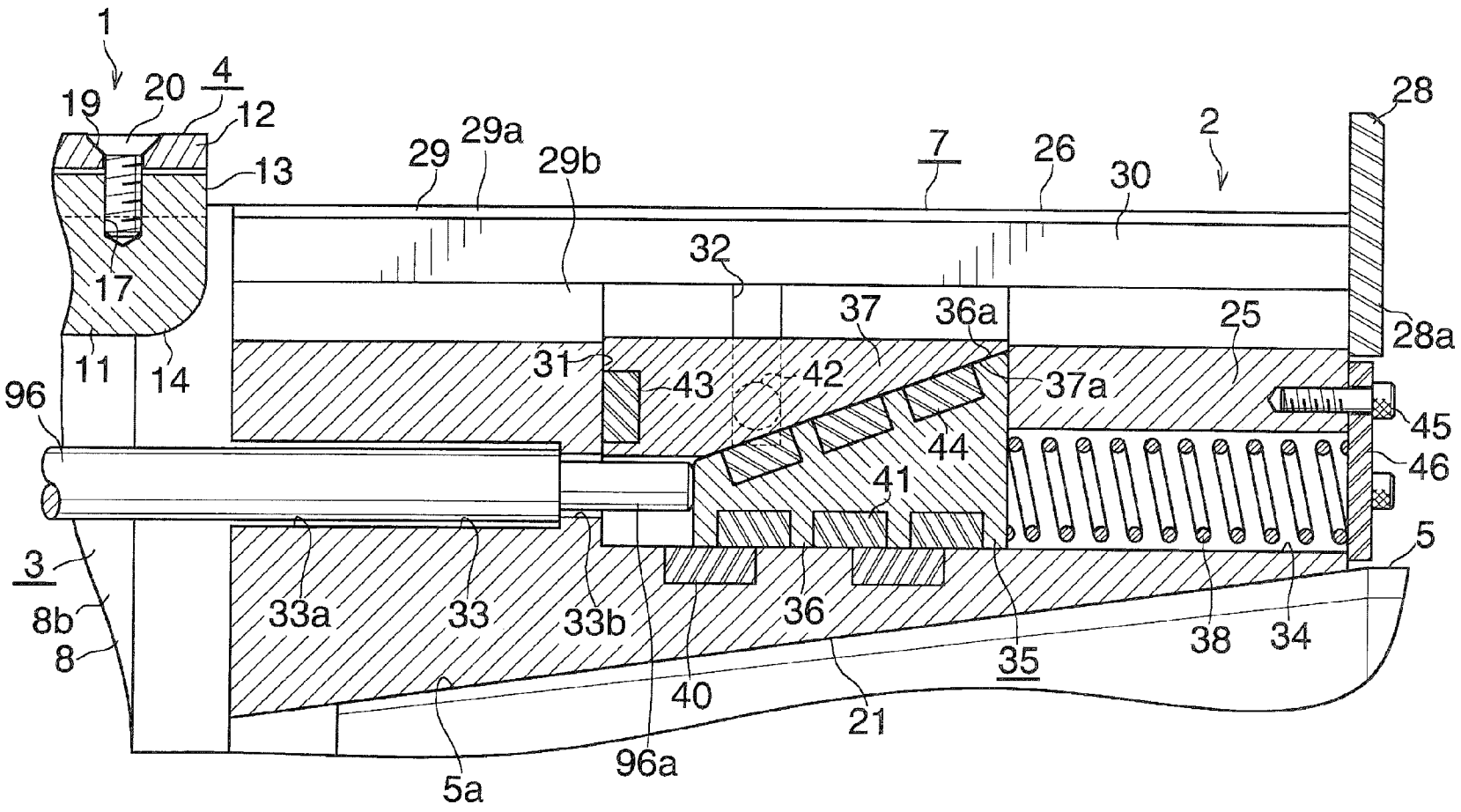
FIG. 9 is an enlarged vertical cross-sectional view of the same portion as FIG. 8 illustrating a different state from FIG. 8.
Figure 10:
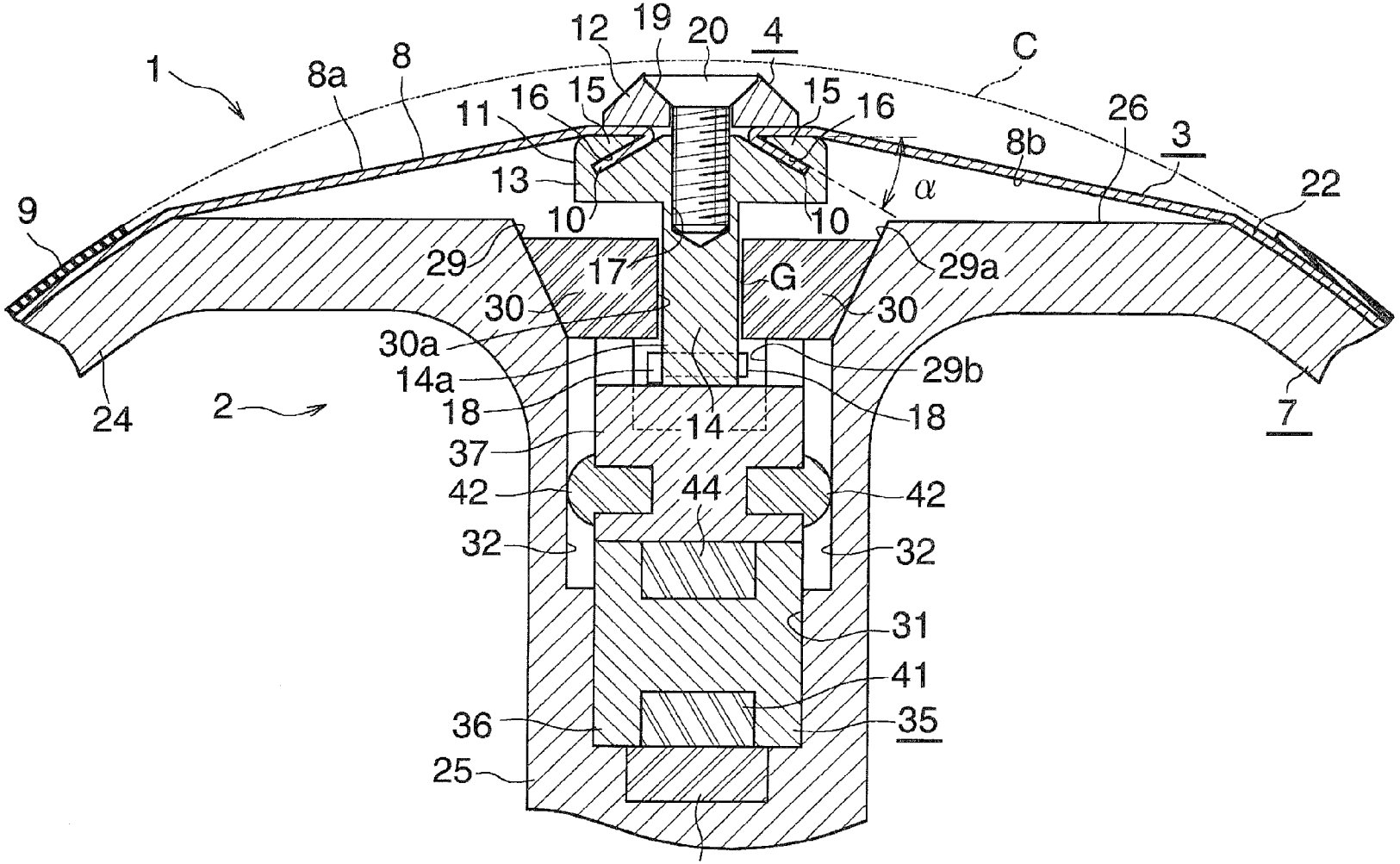
FIG. 10 is an enlarged lateral cross-sectional view taken along the line X-X in FIG. 4.
Figure 11:
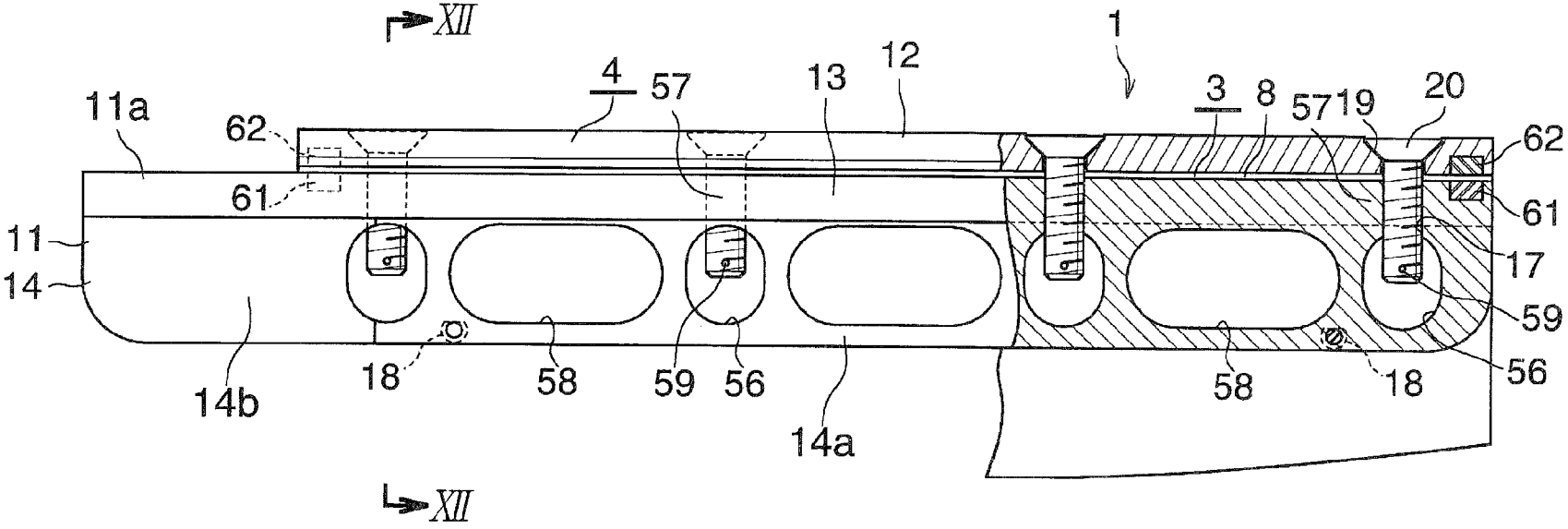
FIG. 11 is a vertical cross-sectional view of a principal portion of a printing plate unit illustrating another embodiment of the invention.
Figure 13:
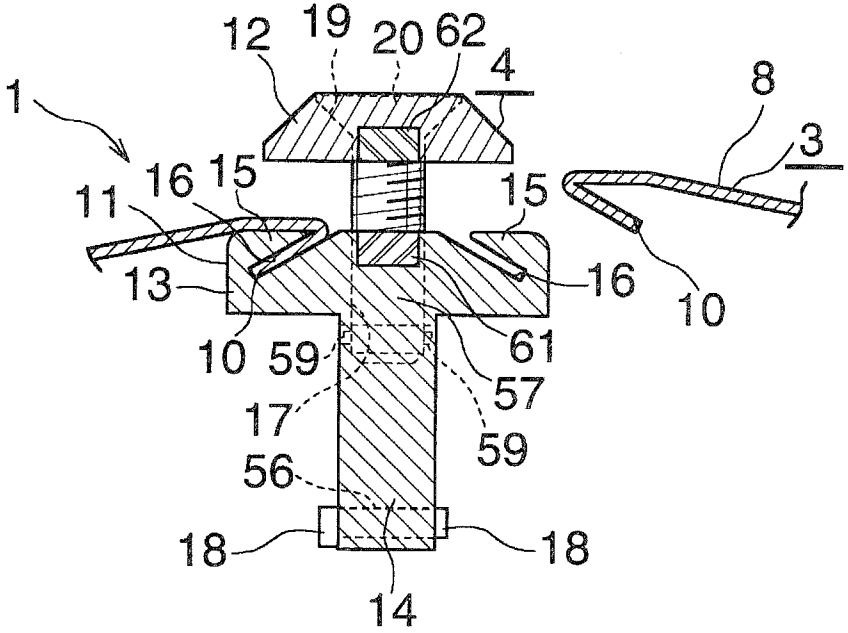
FIG. 13 is an enlarged lateral cross-sectional view of the same portion as FIG. 12 illustrating a different state from FIG. 12.
Figure 12:
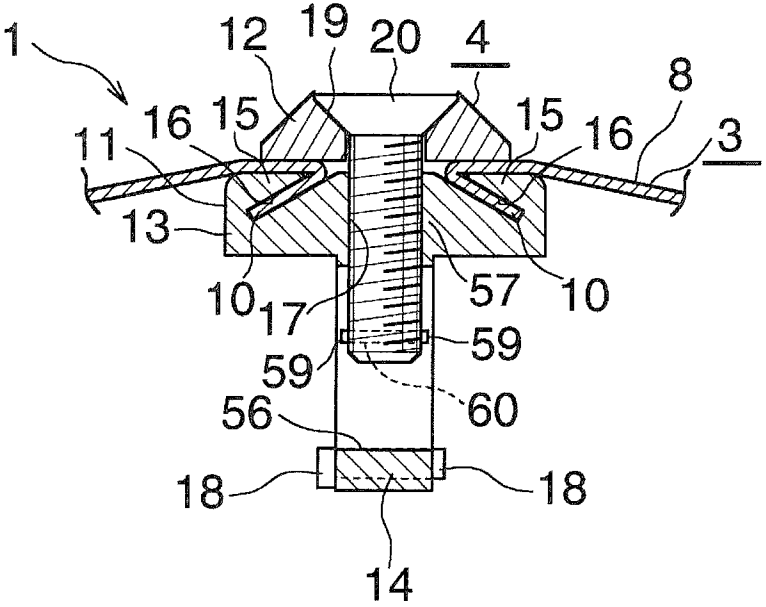
FIG. 12 is an enlarged lateral cross-sectional view taken along the line XII-XII in FIG. 11.

FIG. 1 to FIG. 3 illustrate one embodiment of a printing plate unit (1), FIG. 4 to FIG. 10 illustrate one embodiment of a plate cylinder apparatus for a printer (specifically, a printing plate mounting portion (2) thereof), FIG. 11 to FIG. 13 illustrate another embodiment of the printing plate unit (1), and FIG. 14 to FIG. 20 illustrate one embodiment of a printing plate unit automatic mounting apparatus (81).

The printing plate unit (1) and the printing plate mounting portion of the plate cylinder are configured so as to allow easy automatic mounting of a printing plate (3) and automation (unmanned operation) of mounting of the printing plate is enabled by using the printing plate unit automatic mounting apparatus (81).

As illustrated in FIG. 1, the printing plate unit (1) is formed by coupling and retaining a sheet-shaped printing plate (3) in a cylindrical shape by a printing plate coupling member (4).

Figure 4:
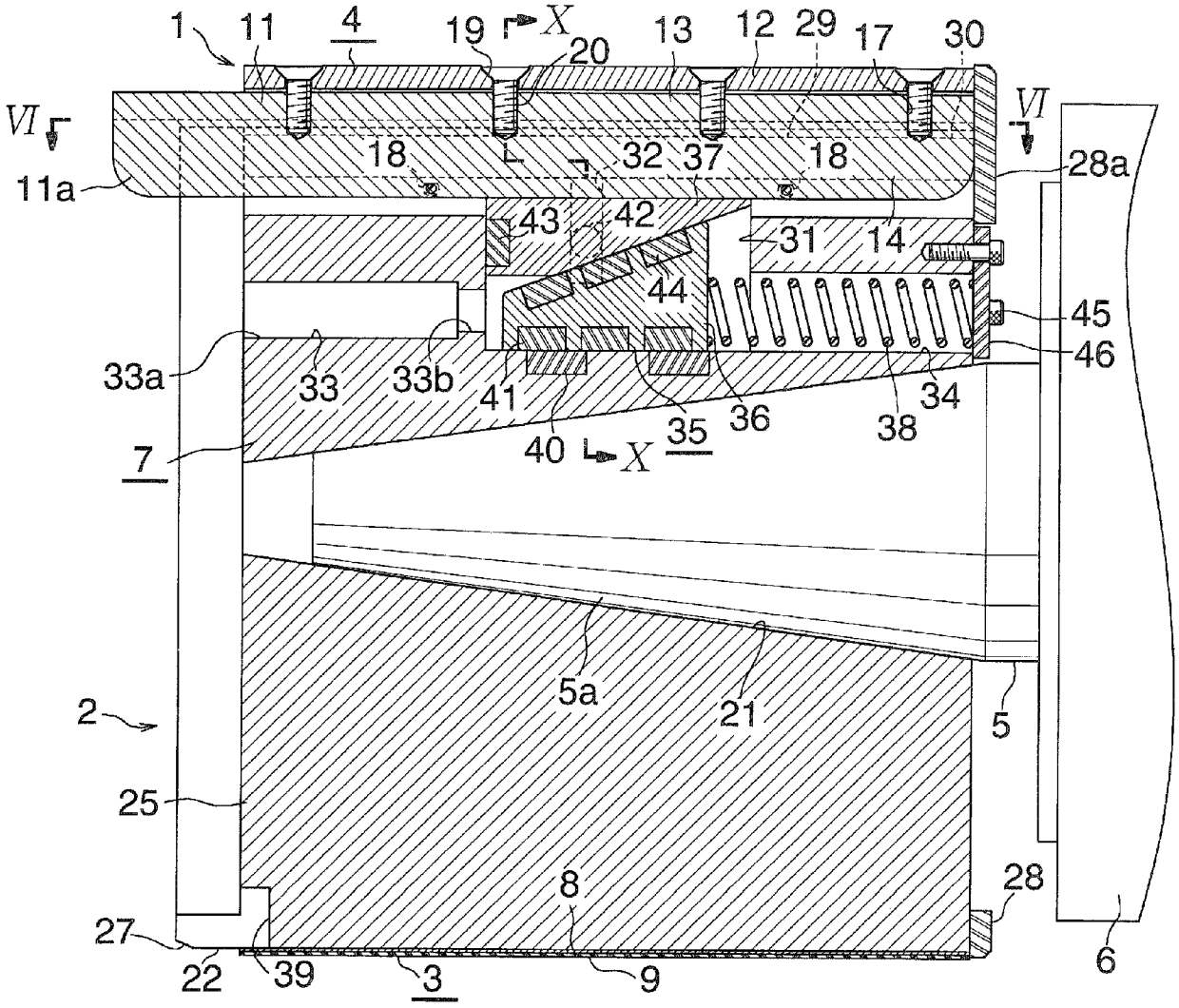
FIG. 4 is a vertical cross-sectional view of a portion of a printing plate mounting portion of a plate cylinder apparatus for a printer illustrating the first embodiment of the invention.

As illustrated in FIG. 4, the plate cylinder apparatus for a printer includes a plate drive shaft (5) disposed horizontally. A portion of a shaft (5) on one end side is rotatably supported by a bearing housing (6) provided on a framework of a printer, which is not illustrated, and a portion of the shaft (5) on the other end side is rotatably supported by a bearing housing, which is not illustrated, provided on the frame work. The printing plate mounting portion (2) is fixed so as to be mountable and demountable on one end portion of the shaft (5) projecting from the bearing housing (6), and is provided with a cylindrical plate cylinder portion (7) to be fixed to one end portion of the shaft (5).

In the following description, an end side of the shaft (5) to which the printing plate mounting portion (2) is fixed (the left side in FIG. 4) is referred to as a front, and the other side (the right side in FIG. 4) is referred to as a rear. A free end side of a front end portion of the shaft (5) to which the printing plate mounting portion (2) is fixed is assumed to be a distal end side, and the side supported by the bearing housing (6) on the opposite side is referred to as a proximal end side. In this specification, an axial direction, a radial direction, and a circumferential direction of the shaft (5), a plate cylinder portion (7), and the printing plate unit (1) are referred to simply as the axial direction, the radial direction, and the circumferential direction, respectively, unless otherwise specifically noted.

Referring to FIG. 1 to FIG. 3, one embodiment of the printing plate unit (1) will be described.

FIG. 1 is a perspective view of the printing plate unit (1), FIG. 2 is an exploded perspective view of the same, and FIG. 3 is an exploded perspective view of a coupling member (4) which constitutes the printing plate unit (1). As illustrated in FIG. 4 and onward, the printing plate unit (1) is mounted and demounted with respect to the printing plate mounting portion (2) in this state.

A surface of the printing plate (3) facing radially outward when being formed into a cylindrical shape is referred to as a front surface, a surface facing radially inward thereof is referred to as a rear surface, and a circumferential direction when being formed into a cylindrical shape is referred to as a longitudinal direction, and an axial direction thereof is referred to as a width direction.

The printing plate (3) includes a sheet (8) formed of a resilient material. The shape of the sheet (8) is arbitrary and, in this example, a square shape. A plate portion (9) is provided on part of the front surface (8*a*) of the sheet (8), and engaging projecting ridges (10) projecting on a rear surface (8*b*) side and extending in axial direction are provided at both end portions in the longitudinal direction.

The plate portion (9) is provided at a predetermined position of the front surface (8*a*) of the sheet (8) except for both end portions, and the front surface of the plate portion (9) corresponds to a plate surface.

The projecting ridges (10) may be formed integrally with or separately from the sheet (8). In this example, the projecting ridges (10) are formed by bending the both end portions of the sheet (8) toward the rear surface (8*b*) side, and extends over the entire width of the sheet (8) integrally with the sheet (8).

Assuming that an angle α (see FIG. 10) formed between the projecting ridge (10) and the rear surface (8*b*) of the sheet (8) adjacent thereto is a projecting angle of the projecting ridge (10), the projecting angle α is preferably smaller than degree. Furthermore, the projecting angle α of the projecting ridge (10) is preferably from 35 to 55 degrees and, more preferably, 45 degrees. In this example, the both end portions of the flat-shaped sheet (8) are bend toward the rear surface (8*b*) side at an angle of approximately 135 degrees, and the projecting angle α is approximately 45 degrees.

The sheet (8) is formed of a suitable metal. In this example, it is formed of SS steel. The thickness of the sheet (8) only needs to be a thickness which is enough to be formed into a cylindrical shape, and enough to retain the cylindrical shape by a resilient force. In this example, it is approximately 0.26 mm. The plate portion (9) is formed of a suitable synthetic resin material suitable for printmaking. The thickness of a combined sheet (8) and the plate portion (9) in this example is approximately 0.82 mm.

The coupling member (4) is provided with an inner clamping member (11) and an outer clamping member (12) configured to clamp the both end portions of the printing plate (3) in the longitudinal direction formed into a cylindrical shape from both inside and outside in the radial direction. In this example, since the projecting ridges (10) of the printing plate (3) project toward the rear surface (8*b*) side of the sheet (8), the inner clamping member (11) engages the projecting ridges (10) from radially inside and the outer clamping member (12) is fixed to the inner clamping member (11) from radially outside so as to be capable of fixedly clamping the both end portions of the printing plate (3). The both clamping members (11) (12) extend in the axial direction.

The axial length of the inner clamping member (11) is set to be longer than the axial length of the outer clamping member (12), and the inner clamping member (11) includes a projecting portion (11*a*) projecting forward with respect to the outer clamping member (12) in a state in which the inner clamping member (11) and the outer clamping member (12) are overlapped with each other. The projecting portion (11*a*) projects axially from the printing plate (3) formed into a cylindrical shape as illustrated in FIG. 1, and as described later, serves as a gripping portion used when being mounted and demounted with respect to the printing plate mounting portion (2).

The inner clamping member (11) is a guided portion that serves as a guide when mounting the printing plate unit (1) to the plate cylinder portion (7). The inner clamping member (11) includes a clamping portion (13) configured to clamp the printing plate (3), and a guided portion (14) formed integrally at a circumferentially center portion of a radially inside surface of the clamping portion (13). The clamping portion (13) has a plate shape having a thickness in the radial direction smaller than the length (width) in the circumferential direction. The guided portion (14) has a plate shape having a thickness in the circumferential direction smaller than the length (height) in the radial direction.

A radially outer portion of the clamping portion (13) is provided with two engaging portions (15) configured to engage portions between the rear surface (8*b*) of the end portions and the projecting ridges (10) of the printing plate (3). A flat surface facing radially outward of the clamping portion (13) is provided with two grooves (16) extending axially over the entire length of the clamping portion (13), and portions between the grooves (16) and the above-described flat surface correspond to the engaging portions (15). The both grooves (16) are inclined so as to be away from each other as they go to a bottom side, and an angle between the grooves (16) and the above-described flat surface, that is, the angle of the engaging portions (15) is substantially the same as the projecting angle α of the projecting ridges (10) of the printing plate (3). The width of the grooves (16) is slightly larger than the thickness of the portion of the projecting ridge (10) of the printing plate (3). A plurality of screw holes (17) each provided with a female thread are formed at a predetermined interval in the axial direction in a portion between the both grooves (16) on the flat surface facing radially outward of the clamping portion (13).

Figure 7:
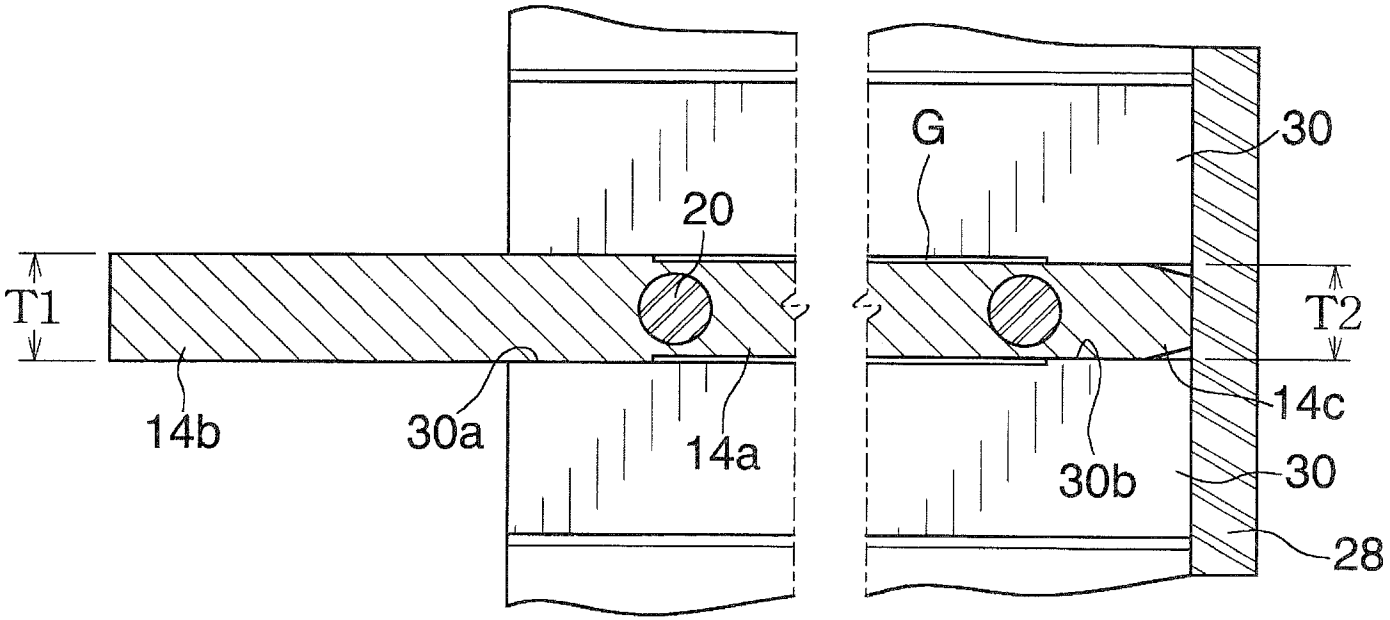
FIG. 7 is an enlarged drawing illustrating a principal portion of FIG. 6.

The guided portion (14) includes a thin portion (14*a*) being relatively long in the axial direction, a thick portion (14*b*) provided on one end side (the side where the projecting portion (11*a*) exists) of the thin portion (14*a*), and a tapered portion (14*c*) provided on the other end side (the opposite side from the projecting portion (11*a*)) of the thin portion (14*a*). The lengths of the respective portions (14*a*) (14*b*) (14*c*) in the radial direction are the same. As illustrated in FIG. 7 in an enlarged scale, a thickness T1 of the thick portion (14*b*) in the circumferential direction is larger than a thickness T2 of the thin portion (14*a*) in the circumferential direction. The tapered portion (14*c*) gradually decreases in thickness in the circumferential direction with respect to the thin portion (14*a*).

The guided portion (14) is provided with movement restricting projections (18) projecting on both sides in the circumferential direction thereof at portions near to radially inner end of the flat surfaces facing both sides in the circumferential direction. In this example, two projections (18) are provided on each of the surfaces at a relatively large distance from each other in the axial direction. The projections (18) may be formed integrally with the guided portion (14), but in this example, are formed of portions of movement restricting pins press-fitted into holes, which are not illustrated, formed on the surfaces of the guided portion (14) by suitable means such as press fitting or the like projecting from the surfaces. Although illustration is omitted, a plurality of portions are preferably removed from the guided portion (14) or the like for reducing the weight of the inner clamping member (11).

The outer clamping member (12) has a plate shape having a thickness smaller in the radial direction than the length (width) in the circumferential direction. The radially inside surface of the outer clamping member (12) is a flat surface. A circumferentially center portion of a radially outside surface of the outer clamping member (12) is a flat surface. The thickness of the both end portions of the outer clamping member (12) in the circumferential direction is reduced as it goes circumferentially outward. The outer clamping member (12) is provided with the same number of dish-like counter-bored screw insertion through holes (19) are formed corresponding to the screw holes (17) of the inner clamping member (11). As described later in detail, the both clamping members (11) (12) are fixed to each other with a plurality of flat head screws (clamping screw members) (20).

In the case where the printing plate unit (1) is assembled from the printing plate (3) and the both clamping members (11) (12), first, as illustrated by an arrow in FIG. 2, the both end portions of the plate-shaped printing plate (3) in the longitudinal direction are bent toward the rear surface side to form a cylindrical shape, the projecting ridges (10) are fitted in the groove (16) on the inner clamping member (11) and are engaged with the engaging portion (15). As illustrated in FIG. 1, the outer clamping member (12) is overlapped with the inner clamping member (11) and the end portions of the printing plate (3) from radially outside, and screws (20) are inserted into through holes (19) and fixed to the inner clamping member (11) by being crewed into the screw holes (17). Accordingly, the both end portions of the printing plate (3) in the longitudinal direction are coupled by being fixedly clamped by the both clamping members (11) (12), so that the cylindrical printing plate unit (1) is formed.

When disassemble the printing plate unit (1), the screws (20) are loosened, the both clamping members (11) (12) are separated from each other or the both clamping members (11) (12) are separated from each other by a required extent in a state in which the screws (20) are fitted in the screw holes (17) of the inner clamping member (11) and are removed from the printing plate (3). After the disassembly, storage in a state in which the both clamping members (11) (12) are tightened with the screws (20) is possible, and storage in a state in which the both clamping members (11) (12) and the screws (20) are separated is also applicable.

Materials of the both clamping members (11) (12) may be any material as long as it is a suitable metal and, in this example, S55C steel is used.

A plate portion (9) of the printing plate (3) is formed of a suitable synthetic resin such as UV cured resin or the like. A printing pattern of the plate portion (9) may be formed by various methods and, for example, is formed of a laser curving. The curving by a laser may be performed through various known methods. Preferably, however, the curving is performed in a state of a printing plate unit (1).

The printing plate unit (1) is rotated (under conditions similar to those in the printing process), and is subjected to laser curving by a laser machining apparatus provided with a printing plate mounting portion (2) described later in detail. The laser beam used in the laser curving is not specifically limited. However, a configuration having a high output is preferable for performing curving at a high speed, so that infrared ray or infrared ray radiating solid-state laser such as a carbon dioxide laser, a YAG laser, and a semiconductor laser may be used.

The printing plate unit (1) is mounted on the printing plate mounting portion (2) in this state (in the state of being formed into a cylindrical shape), lowering of accuracy in association with mounting and demounting is prevented and a machining accuracy of the plate portion (9) of the printing plate (3) can be enhanced by forming a printing pattern of the plate portion (9) in a state of the printing plate unit (1).

Figure 5:
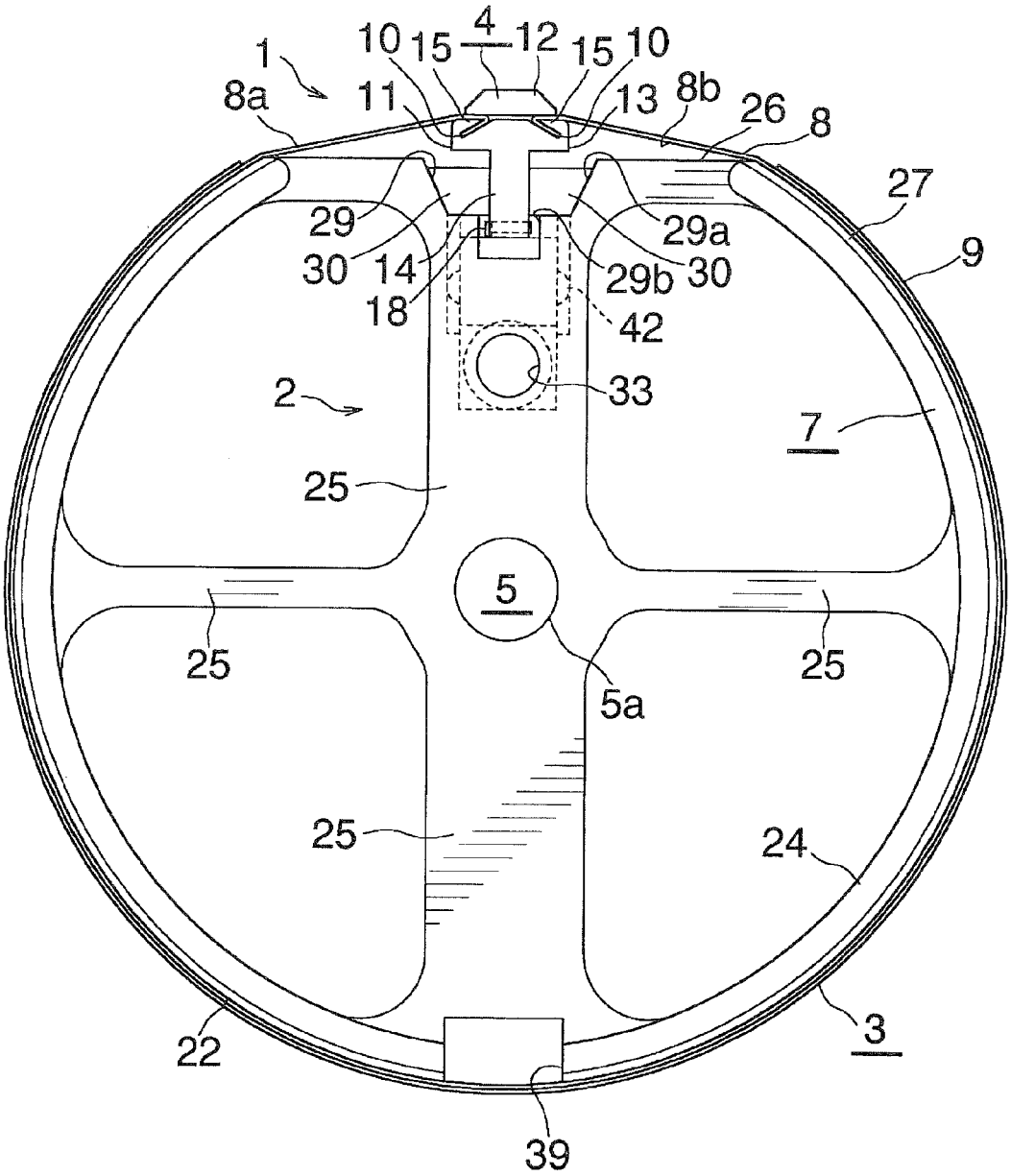
FIG. 5 is a front view of a printing plate mounting portion in FIG. 4.
Figure 6:
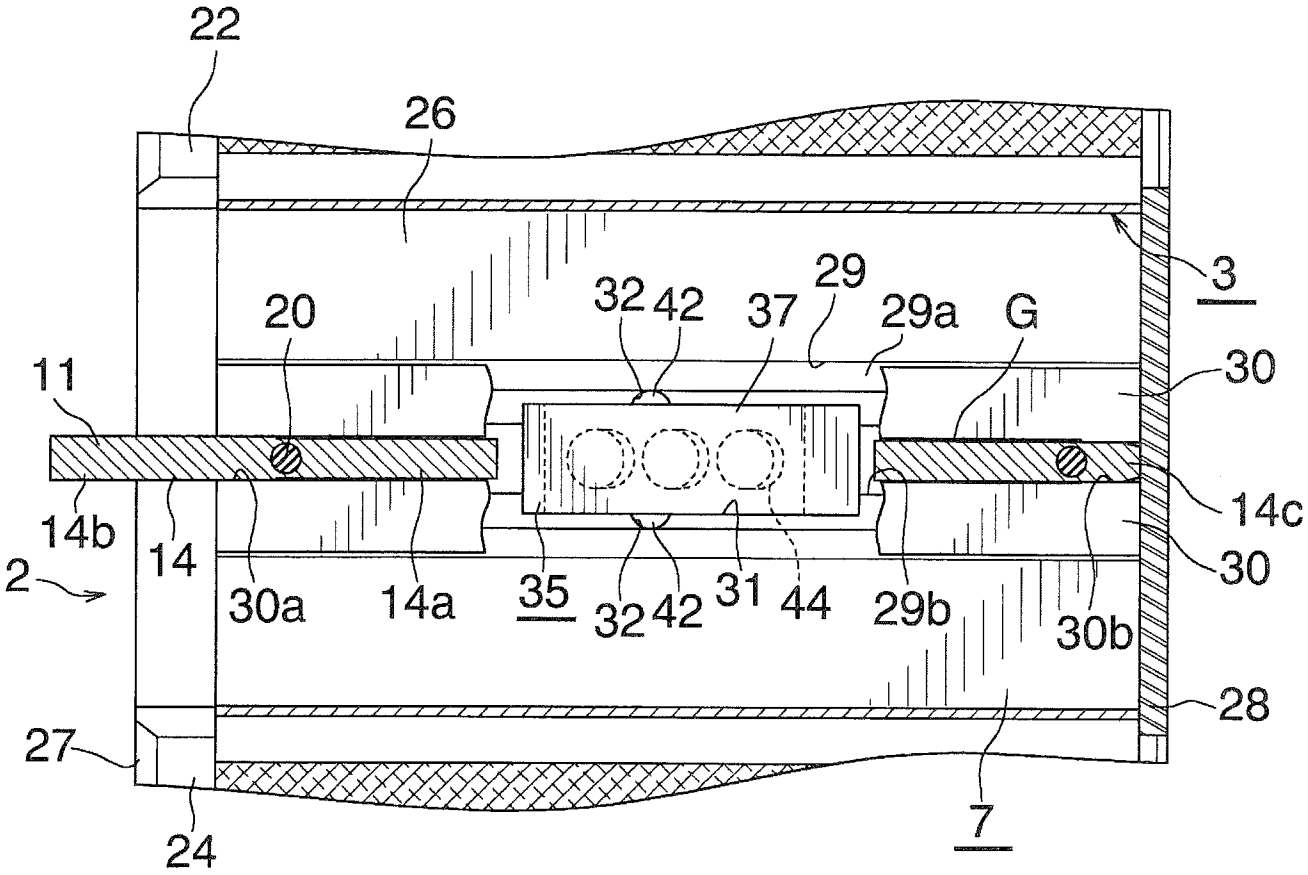
FIG. 6 is a partial cross sectional view taken along the line VI-VI in FIG. 4.
Figure 8:
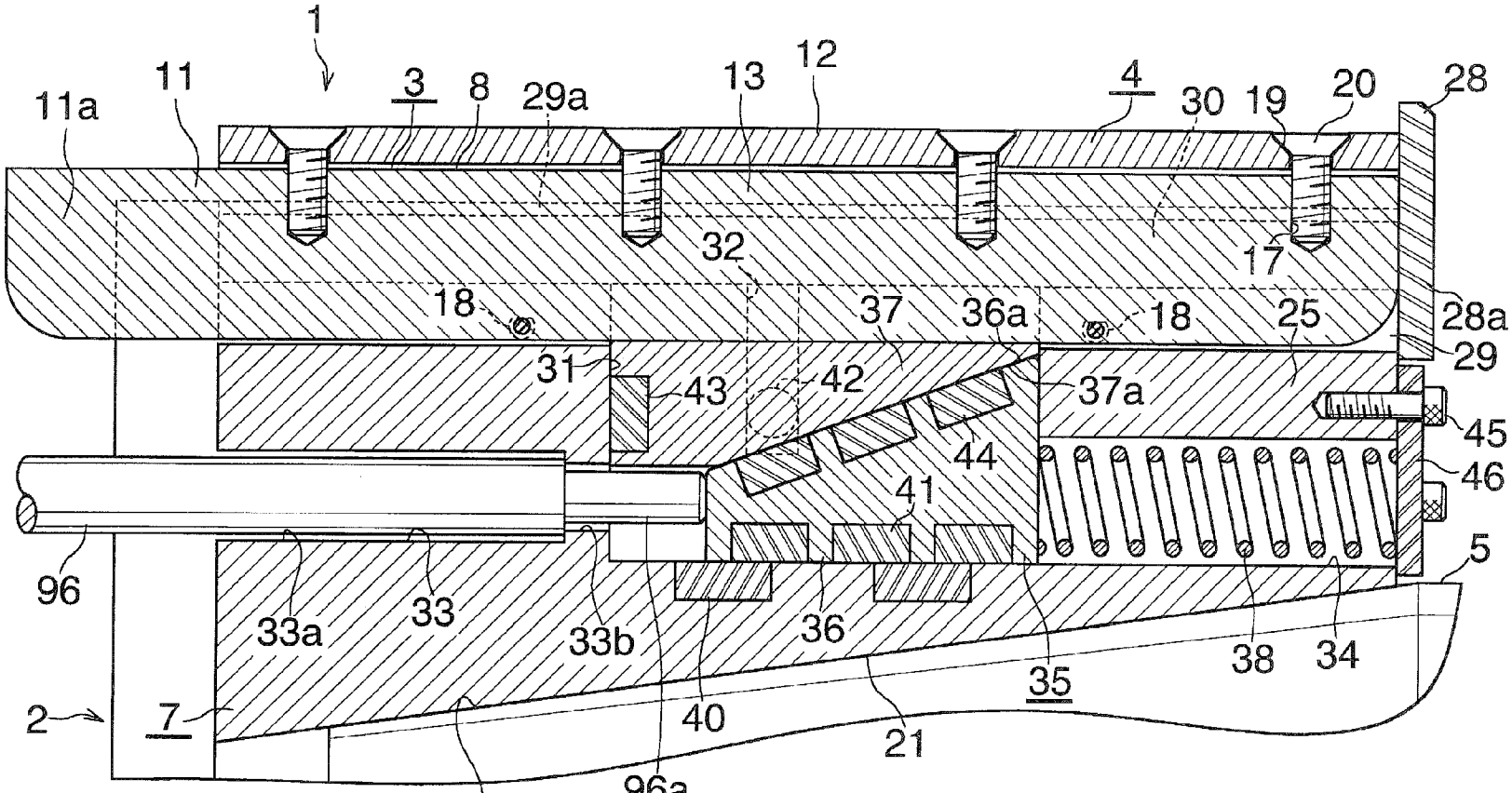
FIG. 8 is a vertical cross-sectional view illustrating part of FIG. 4 in an enlarged scale.

Referring to FIG. 4 to FIG. 10, one embodiment of the printing plate mounting portion (2) of the plate cylinder apparatus for a printer will be described. FIG. 4 is a vertical cross-sectional view of a portion of the printing plate mounting portion (2), FIG. 5 is a front view of a printing plate mounting portion (2) illustrated in FIG. 4, FIG. 6 is a partial cross sectional view taken along the line VI-VI in FIG. 4, FIG. 7 is an enlarged drawing illustrating a principal portion of FIG. 6, FIG. 8 is a vertical cross-sectional view illustrating part of FIG. 4 in an enlarged scale, FIG. 9 is an enlarged vertical cross-sectional view of the same portion as FIG. 8 illustrating a different state from FIG. 8, and FIG. 10 is an enlarged cross-sectional view taken along the line X-X in FIG. 4.

The plate drive shaft (5) of the plate cylinder apparatus is rotated at a predetermined speed in a predetermined direction by known driving means, which is not illustrated. A tapered portion (5*a*) is formed at a front end portion of the drive shaft (5) projecting from a bearing housing (6).

The plate cylinder portion (7) is mountably and demountably fixed to the tapered portion (5*a*) of the drive shaft (5). The plate cylinder portion (7) is formed into a cylindrical shape provided with a tapered hole (21) having an inner diameter decreasing as it goes to the front side at a center thereof, and a cylindrical plate mounting surface (22) concentric with the shaft (5) is formed on the outer periphery thereof. In order to reduce the weight, a plurality of portions (four portions in this example) in the circumferential direction of the plate cylinder portion (7) are removed over the entire length in the fore-and-aft direction. Accordingly, the plate cylinder portion (7) includes the inner tapered cylindrical portion (23) provided with the tapered hole (21) formed in the inner periphery thereof, an outside cylindrical portion (24) provided with the plate mounting surface (22) formed on an outer periphery thereof, and a plurality of coupling portions (25) configured to couple these members. The plate cylinder portion (7) is fixed to the shaft (5) by means of a screw or the like, which is not illustrated, in a state in which the tapered portion (5*a*) of the shaft (5) is fitted in the tapered hole (21), and rotates integrally with the shaft (5).

Materials of the plate cylinder portion (7) may be formed of any suitable metals such as cast iron and, in this example, a ductile cast iron, which is a magnetic material.

In a portion corresponding to one coupling portion (25) (located on an upper side in FIG. 5) of the outer cylindrical portion (24) of the plate cylinder portion (7), part of the cylindrical surface is removed to form a flat grove formed surface (26), and portion except for the groove formed surface (26) of the outer cylindrical portion (24) corresponds to the plate mounting surface (22). The plate portion (9) of the printing plate (3) is formed on a portion of the sheet (8) which comes in tight contact with the plate mounting surface (22) when the printing plate unit (1) is mounted on the plate cylinder portion (7), and the circumferential length of the plate mounting surface (22) is longer than the circumferential length of the plate portion (9). A tapered portion (27) is formed by chamfering at a front end portion of the plate mounting surface (22), and an outer diameter of the plate mounting surface (22) except for the tapered portion (27) is constant over the entire length.

An annular stopper member (28) slightly protruding on the radially outside of the plate mounting surface (22) is fixed to the outer peripheral portion of the rear end surface of the outer cylindrical portion (24) of the plate cylinder portion (7) by suitable means such as a screw, which is not illustrated. The stopper member (28) constitutes an axial direction positioning stopper portion. A receiving portion (28*a*) projecting radially inward is integrally formed on a portion of the stopper member (28) corresponding to the circumferential center portion of the groove formed surface (26) as illustrated in FIG. 4. An amount of protrusion from the outer peripheral surface of the plate mounting surface (22) of the stopper member (28) is smaller than the thickness of a combination of the sheet (8) of the printing plate (3) and the plate portion (9), and larger than the thickness of the sheet (8). In this example, it is approximately 0.5 mm.

A printing plate coupling member accommodating groove (29) in which an inner clamping member (11) of the printing plate coupling member (4) of the printing plate unit (1) is fitted is formed over the entire axial length of the circumferential center portion of the groove formed surface (26) corresponding to the coupling portion (25). The groove (29) includes a radially outside trapezoidal groove portion (29*a*) increased in circumferential width as it goes radially outward and an angular groove portion (29*b*) formed on the bottom of the trapezoidal groove portion (29*a*). The circumferential width of the angular groove portion (29*b*) is slightly smaller than the width of the bottom of the trapezoidal groove portion (29*a*) and is slightly larger than the circumferential width (circumferential thickness of the thick portion (14*b*)) of the guided portion (14) of the inner clamping member (11). A rear end of the groove (29) is closed by a receiving portion (28*a*) of the stopper member (28).

A pair of guide members (30) which constitute part of a printing plate coupling member guiding portion configured to guide the inner clamping member (11) in the axial direction and also guide the same so as to move within a predetermined range in the radial direction are fixed to the bottom portion of the trapezoidal groove portion (29*a*). The guide member (30) is fixed by means of a suitable means such as a screw, which is not illustrated in a form of being in tight contact with a bottom wall and both side walls of the bottom portion of the trapezoidal groove portion (29*a*) over the entire length in the axial direction and constitutes a guide ridge. Guided portion fitting groove portions (30*a*) (30*b*) extending in the fore-and-aft direction are formed by surfaces of a pair of the guide members (30) facing in the circumferential direction.

The widths of the guided portion fitting groove portion (30*a*) (30*b*) are smaller than the width of the angular groove portion (29*b*), and is slightly larger than the width of the guided portion (14) of the inner clamping member (11). Specifically, as illustrated in FIG. 6 and FIG. 7, the guided portion fitting groove portions (30*a*) (30*b*) include the wide guided portion fitting groove portion (30*a*) in which the thick portion (14*b*) of the guided portion (14) of the inner clamping member (11) fits without rattling and the narrow guided portion fitting groove portion (30*b*) in which a distal end portion of the guided portion (14) fits without rattling. A rear end surface of the thick portion (14*b*) of the guided portion (14) abuts with a front end edge portion of the narrow guided portion fitting groove portion (30*b*), so that the further rearward movement of the guided portion (14) is prevented. In this state, the guided portion (14) is capable of sliding with respect to the guided portion fitting groove portions (30*a*) (30*b*) and moving in the radial direction. The axial length of the wide guided portion fitting groove portion (30*a*) is larger than the axial length of the narrow guided portion fitting groove portion (30*b*). Therefore, a gap (G) exists between a side surface of the wide guided portion fitting groove portion (30*a*) and the thin portion (14*a*) of the guided portion (14).

The difference between the width between the opposed surfaces of the guide member (30) and the width of the angular groove portion (29*b*) is preferably reduced as much as possible within a range that does not prevent a smooth movement of the guided portion (14) of the inner clamping member (11). The radial height of the guide member (30) is smaller than the radial distance between the radially inside surface of the clamping portion (13) of the inner clamping member (11) and the movement restricting projection (18).

A biasing apparatus accommodating depression (31) having a width slightly larger than the circumferential width of the angular groove portion (29*b*) is formed at an axial center portion of the bottom of the trapezoidal groove portion (29*a*). A vertical cross-sectional shape (see FIG. 9) and a lateral cross-sectional shape (see FIG. 10) of the depression (31) both have a square shape. The radial depth of the depressions (31) is larger than the circumferential width thereof and the axial length is larger than the depth. A guide groove (32) which extends in the radial direction and reaches a radially outside end of the depression (31) is formed on both side walls of the depressions (31) opposing to each other.

The pressing member insertion opening (33) which extends from a front end portion of a coupling portion (25) to the depression (31) is formed at a front portion of the coupling portion (25) provided with the biasing apparatus accommodating depression (31). The pressing member insertion opening (33) extends from the front end of the coupling portion of the plate cylinder portion (7) to the depression (31), and faces the front end surface of an inner slider (36) from the front side. The pressing member insertion opening (33) has a large-diameter circumferential surface (33*a*) on a front side and a small-diameter circumferential surface (33*b*) continuing to a rear end side thereof. A resilient member accommodating hole (34) which extends from the depression (31) to a rear end of the coupling portion (25) is formed at a rear portion of a portion where the pressing member insertion opening (33) of the coupling portion (25) is provided.

A printing plate coupling member biasing apparatus (35) configured to bias the guided portion (14) of the inner clamping member (11) of the printing plate unit (1) mounted on the plate cylinder portion (7) radially outward as described later is provided on portions of the biasing apparatus accommodating depression (31) and a hole (34).

A biasing apparatus (35) includes an inner slider (36) and an outer slider (37) disposed in the biasing apparatus accommodating depression (31), and a compressed coil spring (38) disposed in the hole (34).

The inner slider (36) is formed into a trapezoidal thick plate shape having a small radial height on a front side, and an axial length thereof is smaller than a length of the depression (31). The inner slider (36) is disposed so as to be capable of sliding in the axial direction between a front end position which corresponds to a front end wall and a rear end position which corresponds to a rear end wall along a bottom wall and both side walls of the depression (31). A wedge surface (36*a*) facing a front side is formed over entirely of a radially outward of the inner slider (36). The inner slider (36) in this example is formed of S55C steel.

A plurality of front and rear first permanent magnets (40) are embedded in the bottom wall of the biasing apparatus accommodating depression (31). A plurality of front and rear second permanent magnets (41) are embedded in the radially inside surface of the inner slider (36). The first permanent magnet (40) and the second permanent magnet (41) are disposed so as to attract each other, and the inner slider (36) is configured to slide in the fore-and-aft direction in a state in which the inner slider (36) is in tight contact with the bottom wall of the depression (31) by a magnetic attraction force.

The outer slider (37) is disposed radially outward of the inner slider (36). The outer slider (37) is formed into a trapezoidal thick plate shape having a small radial height on the rear side, and the axial length thereof is slightly smaller than the axial length of the depression (31). A portion of the outer slider (37) other than the front portion on the radially inside is provided with a wedge surface (37*a*) facing rearward so as to oppose a wedge surface (36*a*) of the inner slider (36). The outer slider (37) in this example is formed of S55C steel.

Guiding projections (42) projecting circumferentially both sides and configured to be fitted in the guide groove (32) of the depression (31) are provided on the circumferential both sides of the outer slider (37) at positions corresponding to each other. The projections (42) may be formed integrally with the outer slider (37), but in this example, are formed of portions projecting from the surfaces of the movement restricting pins press-fitted into holes formed on the surfaces of the outer slider (37) by suitable means such as press fitting or the like. The outer slider (37) can slide in the radial direction along the both front and rear end walls of the depression (31) and both side walls, and the wedge surface (37*a*) can slide relatively with the wedge surface (36*a*) of the inner slider (36) in a state in which the projections (42) are fitted to the guide groove (32). A third permanent magnet (43) is embedded in the front end surface of the outer slider (37), so that the outer slider (37) can slide in the radial direction in a state of being in tight contact with the front end wall of the depression (31) by a magnetic attraction force. A fourth permanent magnet (44) is embedded in the wedge surface (36*a*) of the inner slider (36), and the wedge surfaces (36*a*) (37*a*) of the inner and outer sliders (36) (37) slide in a state of being in tight contact with each other by the magnetic attraction force thereof.

A rear end of a resilient member accommodating hole (34) is closed by a lid (46) fixed to a coupling portion (25) with a bolt (45). A spring (38) is stored between the lid (46) and the rear end surface of the inner slider (36) from the hole (34) to the biasing apparatus accommodating depression (31) in a compressed state, and constitutes a resilient member configured to bias the inner slider (36) toward the front.

A long column-shaped pressing member (96) can be inserted from the front side of a plate cylinder portion (7) into a pressing member insertion opening (33) as illustrated in FIG. 8 and FIG. 9.

A pressing member (96) is configured to have a small diameter portion (96*a*) at a distal end thereof. The diameter of the pressing member (96) is larger than a small-diameter circumferential surface (33*b*) of the opening (33), and has a diameter enough to loosely fitted to a large-diameter circumferential surface (33*a*) of the opening (33). The small diameter portion (96*a*) of the pressing member (96) has a diameter enough to loosely fit into the small-diameter circumferential surface (33*b*) of the opening (33).

When the pressing member (96) is inserted from the pressing member insertion opening (33), the pressing member (96) is received by a shouldered surface between a large diameter portion (33*a*) and a small diameter portion (33*b*) of the pressing member insertion opening (33) and, at this time, a distal end portion (96*a*) of the pressing member (96) moves the inner slider (36) rearward.

Therefore, by moving the pressing member (96) inserted from the pressing member insertion opening (33) rearward, the inner slider (36) can be moved rearward against a resilient force of the spring (38). Accordingly, the outer slider (37) moves radially inward. Both of FIG. 8 and FIG. 9 illustrate a state in which the inner slider (36) moves to a rear end position and the outer slider (37) is moved to an innermost position.

When the pressing member (96) is moved toward the front from a state in FIG. 8 and FIG. 9, the inner slider (36) moves toward the front by a resilient force of the spring (38). Accordingly, the outer slider (37) moves radially outward. FIG. 4 illustrates a state in which the pressing member (96) is pulled out, the inner slider (36) is moved to a position near the front end position and then the outer slider (37) is moved to a position near the outermost position.

In this manner, by using the pressing member (96), the inner slider (36) can be moved as well. This movement may be achieved manually. However, as illustrated later, by mounting the pressing member (96) on a robot, the movement of the inner slider (36) is enabled without using a manual operation.

A depression (39) depressed radially inward is formed at the front end portion of the plate cylinder portion (7) at a position radially opposing a printing plate coupling member accommodating groove (29). The depression (39) is a member (interference preventing depression) configured to avoid an interference with the second retaining means (95) of the printing plate unit retaining apparatus configured to retain the printing plate unit (1) when the printing plate unit (1) is mounted and demounted with respect to the printing plate mounting portion (2) as described later. The front end surface of the plate cylinder portion (7) may be a surface orthogonal to the axial direction as illustrated and may be a surface approaching gradually from the printing plate coupling member accommodating groove (29) to the depression (39) and is retracted inwardly in the axial direction.

The printing plate (3) is mounted on the mounting apparatus (2) in a state of the printing plate unit (1) in the following manner.

When mounting the printing plate unit (1) on the printing plate mounting portion (2) of the plate cylinder, as illustrated in FIG. 9, the pressing member (96) is moved to the rear side, and the outer slider (37) is moved to the innermost position. In this state, the coupling member (4) is fitted to the groove (29) from the front side so that outside part from the projection (18) of the inner clamping member (11) fits between guide members (30), and a portion of the printing plate (3) is fitted to the periphery of a plate mounting surface (22) of the plate cylinder portion (7). At this time, a dimensional relationship between the plate cylinder portion (7) and the printing plate unit (1) is determined so that a gap is formed between the printing plate (3) and the plate mounting surface (22). Subsequently, the coupling member (4) is moved rearward by being guided by the guide members (30), and as illustrated in FIG. 8, is brought into abutment with a receiving portion (28*a*) of a stopper member (28). Accordingly, since the axial positioning of the printing plate unit (1) is achieved, the pressing member (96) is pulled out from the pressing member insertion opening (33) to achieve a state illustrated in FIG. 4. Accordingly, the inner slider (36) is moved to the front side by a resilient force of the spring (38). In association with this, the outer slider (37) moves radially outward and abuts with a guided portion (14) of the inner clamping member (11) to move the coupling member (4) radially outward. When the coupling member (4) is moved radially outward, the coupling member (4) pulls the printing plate (3) to bring the same into tight contact with the plate mounting surface (22) of the plate cylinder portion (7). When the coupling member (4) is moved radially outward to some extent and a tension of the printing plate (3) and a resilient force of the spring (38) are balanced, the coupling member (4) stops as illustrated in FIG. 4 and FIG. 10. When the coupling member (4) stops, the outer slider (37) stops and the inner slider (36) also stops. Accordingly, mounting of the printing plate (3) is completed, and the printing plate (3) is fixed in a tight contact manner with respect to the plate mounting surface (22) and hence cannot be moved neither in the axial direction nor in the circumferential direction any longer. At this time, the printing plate (3) is in a state of being pulled by a biasing force of the outer slider (37). In a state in which the printing plate unit (1) is mounted on the plate cylinder portion (7) and the printing plate (3) is brought into tight contact with the plate mounting surface (22) in this manner, a dimensional relationship is determined between the plate cylinder portion (7) and the printing plate unit (1) so that the coupling member (4) does not protrude radially outward of an virtual cylindrical surface (C) (see FIG. 10) including the outer peripheral surface of the plate mounting surface (22).

At the time of printing, the plate cylinder portion (7) is rotated in a state in which the printing plate unit (1) is fixed to the plate cylinder portion (7) as described above. At this time, the guided portion (14) of the inner clamping member (11) of the printing plate unit (1) is interposed between a pair of the guide members (30) of the plate cylinder portion (7) and the printing plate (3) is brought into tight contact with the plate mounting surface (22) of the plate cylinder portion (7) by a radially outward force which acts on the coupling member (4) from the comping member biasing apparatus (35), so that the positional misalignment of the printing plate (3) is avoided. Since portions of the printing plate (3) biased to the both ends are clamped between the inner clamping member (11) and the outer clamping member (12) in a state in which the projecting ridges (10) of the printing plate (3) engage engaging portions (15) of the inner clamping member (11), both end portions of the printing plate (3) are reliably fixed to the coupling member (4) and even when the printing plate (3) is pulled, the printing plate (3) is prevented from coming apart from the coupling member (4). Further, as described above, the printing plate (3) is in a state of being pulled by the outer slider (37). Therefore, even when the printing plate (3) is extended by a change with time, the printing plate (3) is not be loosened. Since the coupling member (4) of the printing plate unit (2) is located radially inside of the virtual cylindrical surface (C) described above and the stopper member (28) does not protrude radially outward of the outer peripheral surface of the plate portion (9), the coupling member (4) and the stopper portion (28) do not hinder printing. During the rotation of the plate cylinder portion (7), a centrifugal force acts on the coupling member (4). Assuming that the printing plate (3) is broken, radial constraint of the coupling member (4) is lost and the coupling member (4) moves radially outward along the guide members (30) by a centrifugal force. However, by an abutment of the projection (18) of the coupling member (4) with the guide members (30), the movement of the coupling member (4) stops and hence the coupling member (4) is prevented from jumping out from the plate cylinder portion (7).

When demounting the printing plate unit (1) mounted on the plate cylinder portion (7) as described above, the pressing member (96) is inserted from the pressing member insertion opening (33) in a state in which the plate cylinder portion (7) is stopped, and the inner slider (36) is moved at a rear end position as illustrated in FIG. 9. Accordingly, the outer slider (37) is moved to the innermost position and hence a gap is formed between the printing plate (3) and the plate mounting surface (22), so that the printing plate unit (1) can be demounted easily from the front end of the plate cylinder portion (7) by moving the printing plate unit (1) in the axial direction.

When the printing plate unit (1) is not used, the both clamping members (11) (12) are separated or placed separately from each other as described above to demount the printing plate unit (1) from the printing plate (3), and the printing plate (3) can be stored in a flat shape. Accordingly, a large space is not required for storing the printing plate (3).

Referring to FIG. 11 to FIG. 13, another embodiment of the printing plate unit (1) will be described. FIG. 11 is a vertical cross-sectional view of a principal portion of the printing plate unit, FIG. 12 is an enlarged lateral cross-sectional view taken along the line XII-XII in FIG. 11, and FIG. 13 is an enlarged lateral cross-sectional view of the same portion as FIG. 12 illustrating a different state from FIG. 12. In FIG. 11 to FIG. 13, portions corresponding to the above-described embodiment are designated by the same reference signs.

In the case of this embodiment, the printing plate unit (1) includes the printing plate (3) and the coupling member (4) in the same manner as the above-described embodiment.

The printing plate (3) is the same as that described in the embodiment described above.

The coupling member (4) includes the inner clamping member (11), the outer clamping member (12) and the flat head screws (20) which constitute clamping screw members in the same manner as the above-described embodiment.

A point that a shape of the outer clamping member (12) and the screw insertion through holes (19) are provided is the same as the above-described embodiment.

A point that the inner clamping member (11) is provided with the clamping portion (13) and the guided portion (14) is the same as the above-described embodiment. Screw hole forming hole-shaped portions (56) penetrating through the respective portions in the circumferential direction are formed at a plurality of portions in the axial direction of the guided portion (14), and portions inside the inner clamping member (11) radially outside of the respective hole-shaped portions (56) corresponds to the screw hole formed portions (57). The screw holes (17) which are the same as those in the above-described embodiment are formed so as to radially penetrate through the screw hole formed portions (57). Portions of the guided portion (14) between the screw hole forming hole-shaped portions (56) are provided with weight reduction hole-shaped portions (58) formed so as to penetrate the respective portions in the circumferential direction.

The screw (20) is the same as that in the embodiment described above except for a point that a retaining stopper (59) is provided. The both clamping members (11) (12) are fixed by the screws (20) in the same manner as the above-described embodiment. In a state in which the screws (20) are tightened, distal end side portions of the screws (20) project into the hole-shaped portions (56). In this state, the distal end portions of the screws (20), which are located radially inward away from the screw holes (17), are provided with stoppers (59). The stopper (59) may be of any type as long as it fills at least a part of the screw grooves of the each screw (20). In this example, both end portions of a stopper pin (60) fixed to a hole penetrating through the distal end portion of each of the screws (20) in the diametric direction by press fitting or the like constitute two stoppers (59). The pin (60) is fixed to the distal end portion of the screw (20) in a state in which the screw (20) couples the both clamping members (11) (12) and projects into the hole-shaped portions (56), and from then onward, the both clamping members (11) (12) are retained to be coupled by the screw (20). The stopper (59) projects from the hole of the screw (20) and fill a screw groove. The distal end of the stopper (59) is at substantially the same position as a thread of the screw (20) or a position slightly projecting therefrom, and the portions of the screw (20) and the stopper (59) do not project outward from the both side surfaces of the guided portion (14) in the circumferential direction irrespective of the position of the screw (20) in the direction of rotation.

At one or preferably two portions in the axial direction of the both clamping members (11) (12), in this example, at two portions near the both ends in the axial direction, permanent magnets (61) (62) are embedded in opposed surfaces of the both clamping members (11) (12). At the respective positions, the permanent magnets (61) (62) are disposed in a direction in which the same poles face each other, which is a direction repulsing with each other. In at least the part of one of the screws (20), the outer clamping member (12) is at a stop in a state in which the counter boring portion of the hole (19) abuts with a head portion of the screw (20) by a magnetic repulsive force of the permanent magnets (61) (62). When the screws (20) are loosened, the outer clamping member (12) moves away from the inner clamping member (11) by a magnetic repulsive force in association with the movement of the radially outward of the screws (20). Therefore, the outer clamping member (12) does not have to separate manually from the inner clamping member (11). When the screws (20) are loosened, and the stoppers (59) reach the radially inside end portion of the screw holes (17), the screws (20) cannot be loosened any longer, and a state in which the both clamping members (11) (12) are fixed to the screws (20) is retained. When the screws (20) are tightened, the outer clamping member (12) gets close to the inner clamping member (11) against a magnetic repulsive force of the permanent magnets (61) (62) in association with the movement of the radially inward of the screws (20).

In the case where the printing plate unit (1) is assembled, first, as illustrated in FIG. 13, the screws (20) are loosened, and the outer clamping member (12) is moved away from the inner clamping member (11) by a required amount. Next, the projecting ridges (10) of the printing plate (3) formed into a cylindrical shape are fitted into the groove (16) on the inner clamping member (11) and are engaged with the engaging portions (15). In this state, the screws (20) are tightened and, as illustrated in FIG. 12, the both end portions of the printing plate (3) are clamped between the both clamping members (11) (12).

In the case where the printing plate unit (1) is disassembled, as illustrated in FIG. 13, the screws (20) are loosened, and the outer clamping member (12) is moved away from the inner clamping member (11) and the printing plate (3) is demounted from the inner clamping member (11). After disassembly, the coupling member (4) can be stored in the state where the both clamping members (11) (12) are coupled by the screws (20), and hence handling is easy.

The printing plate unit (1) may be used by being mounted on the printing plate mounting portion (2) of the same plate cylinder as the above-described embodiment. Mounting and demounting of the printing plate unit (1) with respect to the printing plate mounting portion (2) is performed in the same manner as the above-described embodiment. Since portions of the screws (20) and the stoppers (59) do not project outside from the circumferentially both surfaces of the guided portion (14) of the inner clamping member (11), these members do not become obstacles at the time of mounting, printing, and demounting.

Configurations of the printing plate and the printing plate unit, and configurations and the like of the printer and the printing plate mounting portion, are not limited to those of the above-described embodiment, and may be modified as needed.

For example, in the embodiment described above, since the both projecting ridges (10) of the printing plate (3) project to the rear surface sides, the outer clamping member (12) can be overlapped with the inner clamping member (11) radially outside with the both projecting ridges (10) engaged with the inner clamping member (11) and the both end portions of the printing plate (3) can be fixed easily. However, the both projecting ridges (10) of the printing plate (3) may project to the front surface side. In such a case, the both projecting ridges (10) engage engaging portions formed on the outer clamping member (12). In addition, the both projecting ridges (10) of the printing plate (3) may project to directions opposite to each other. In this case, the projecting ridges (10) projecting to the rear surface side engage the engaging portion formed on the inner clamping member (11), and the projecting ridges (10) projecting to the front surface side engage the engaging portions formed on the outer clamping member (12).

Figure 14:
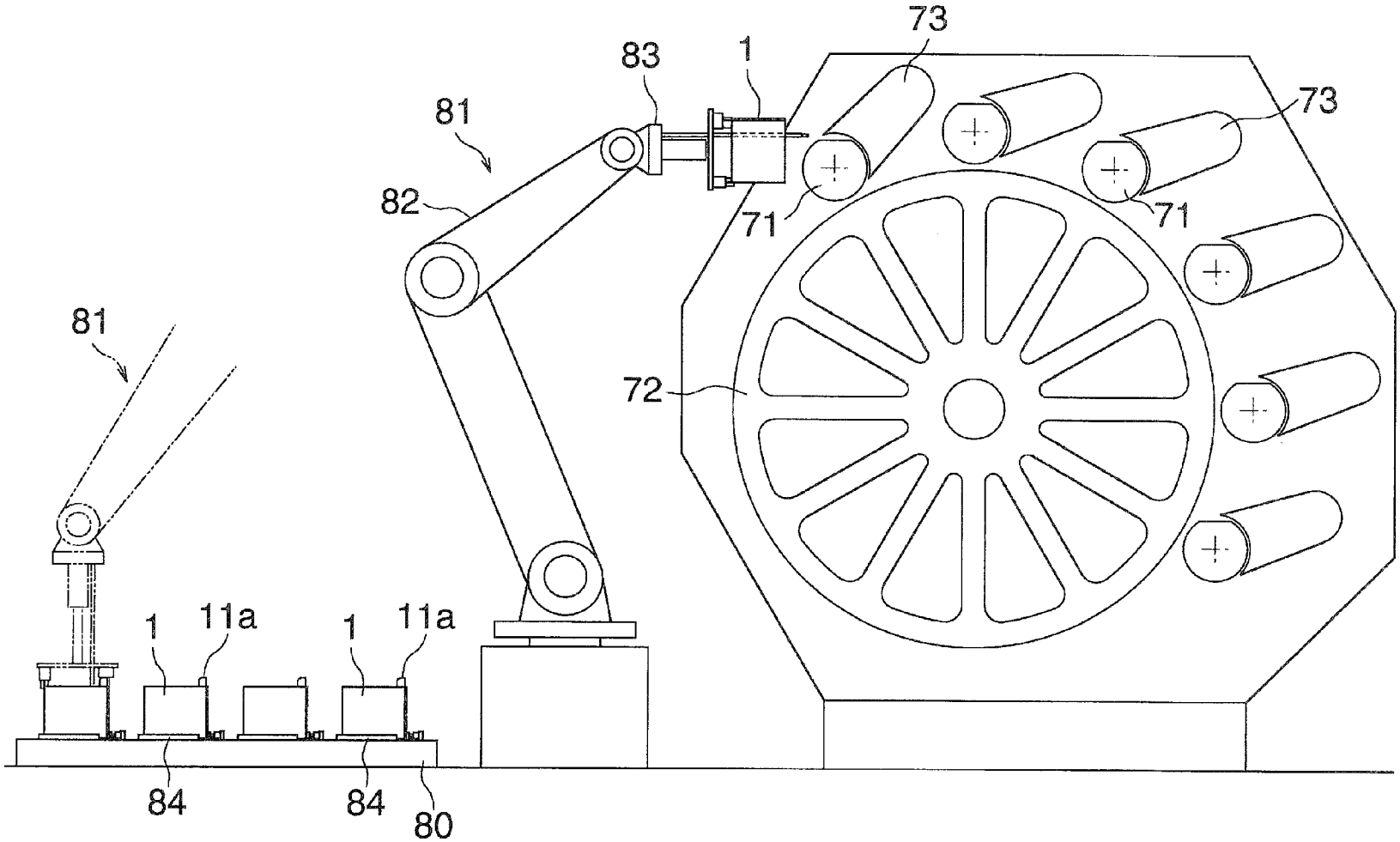
FIG. 14 is a front view of a printing plate unit automatic mounting apparatus schematically illustrating a general configuration.
Figure 15:
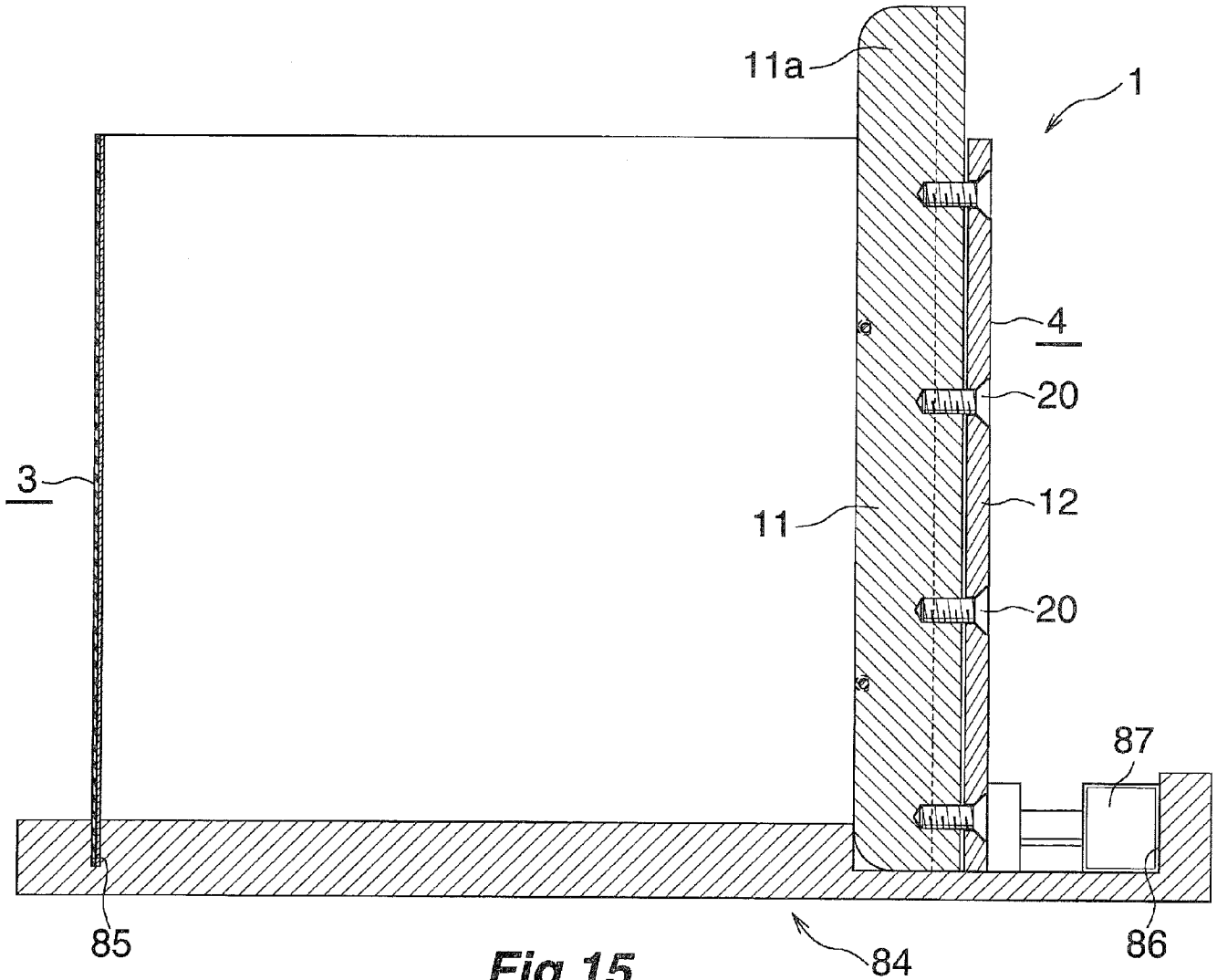
FIG. 15 is a cross-sectional view illustrating an embodiment of a configuration of storage of the printing plate unit in the printing plate unit automatic mounting apparatus.
Figure 16:
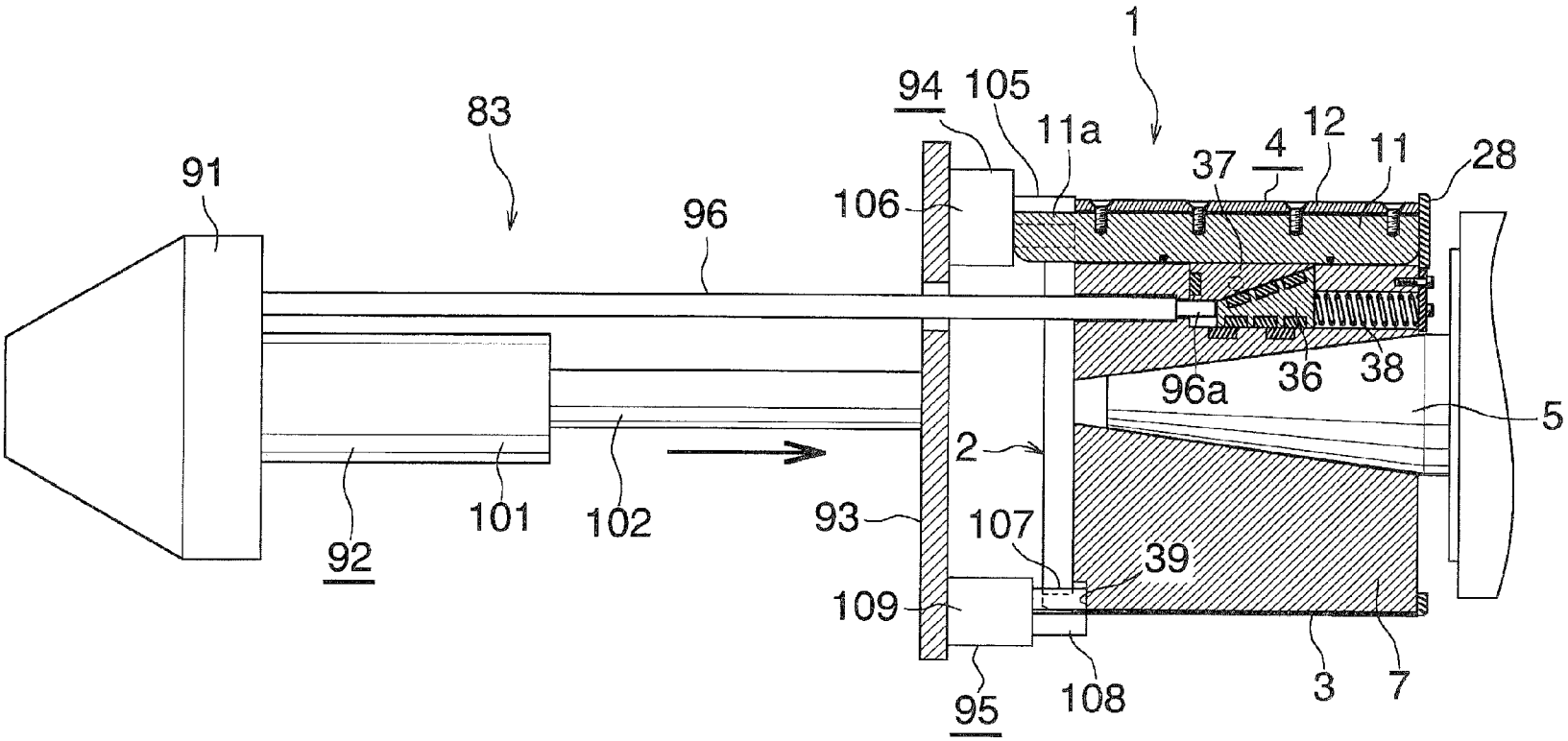
FIG. 16 is a partly broken front view illustrating one process of mounting of the printing plate unit in the printing plate unit automatic mounting apparatus.
Figure 17:
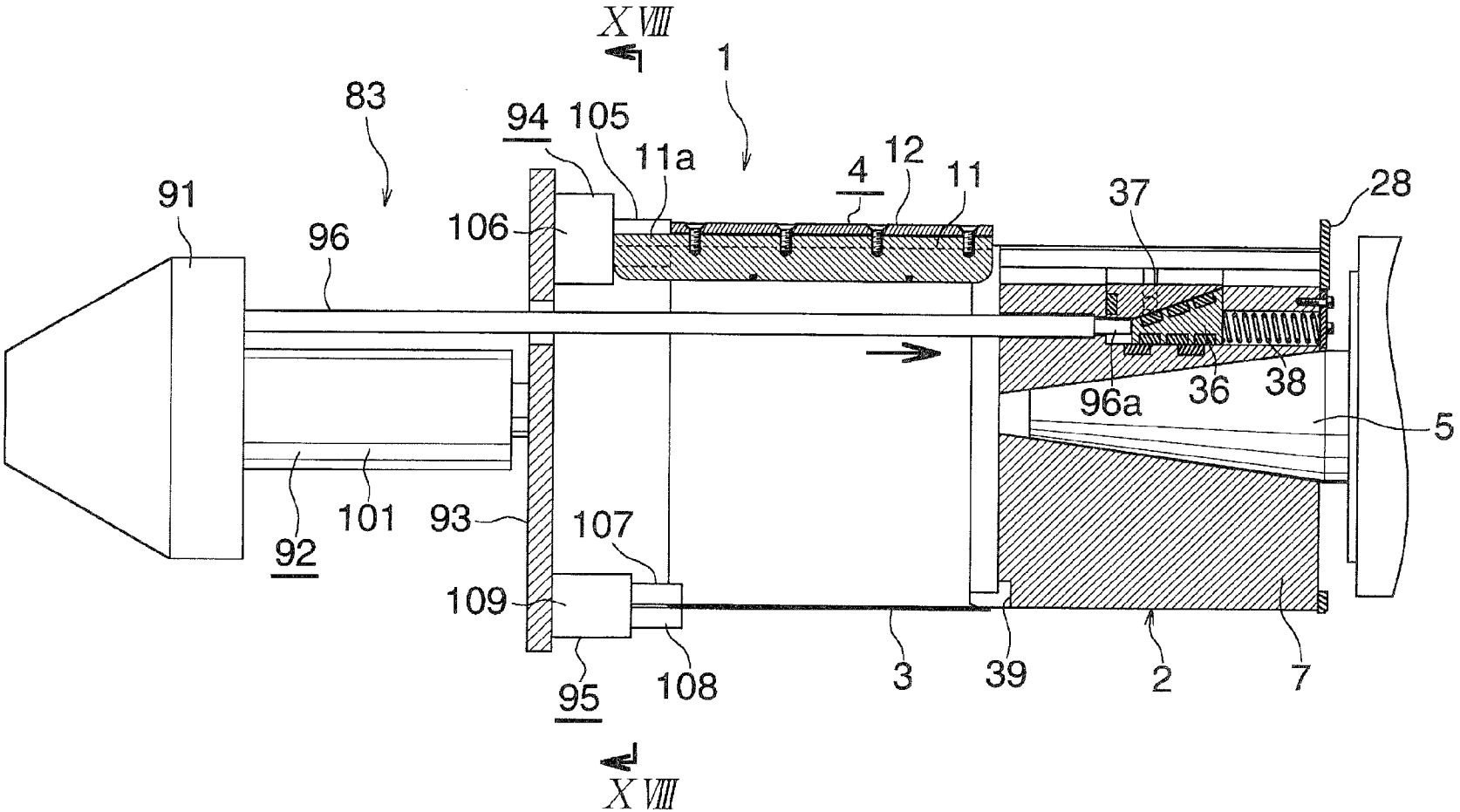
FIG. 17 is a partly broken front view illustrating another process of mounting of the printing plate unit in the printing plate unit automatic mounting apparatus.
Figure 18:
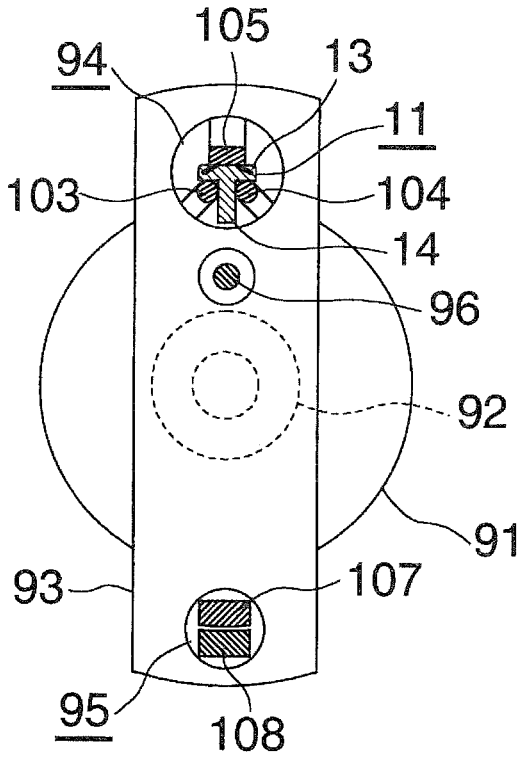
FIG. 18 is an enlarged lateral cross-sectional view taken along the line XVIII-XVIII in FIG. 17.
Figure 19:
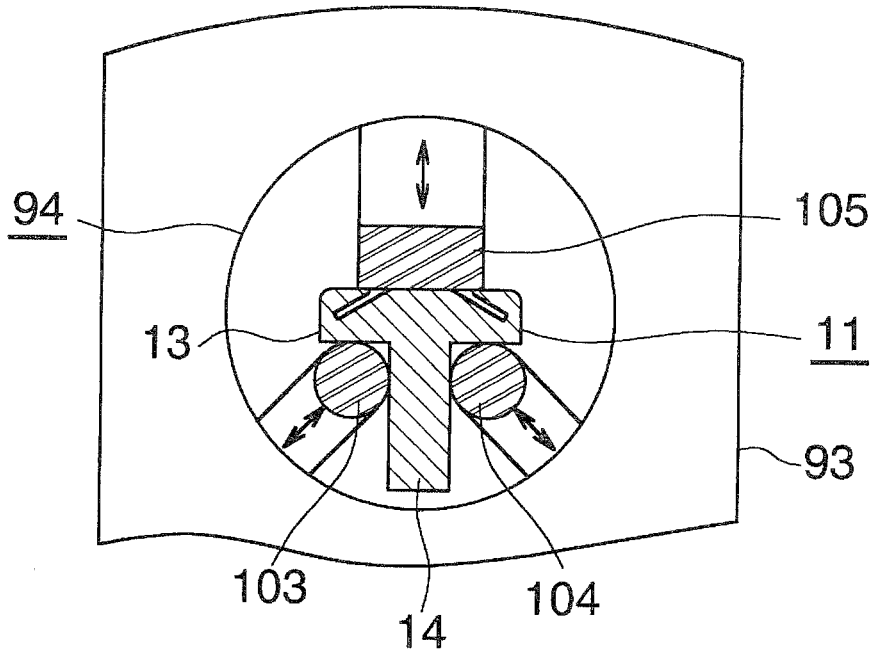
FIG. 19 is an enlarged lateral cross-sectional view illustrating a principal portion (first retaining means) of FIG. 18.
Figure 20:
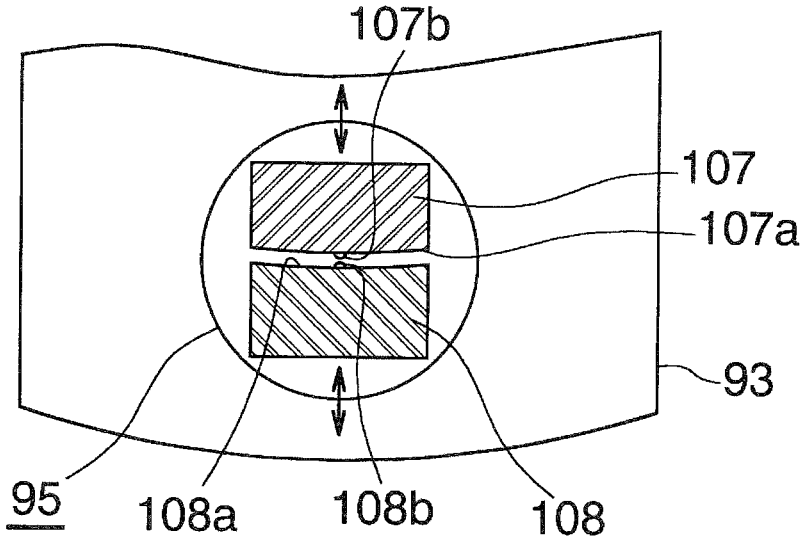
FIG. 20 is an enlarged lateral cross-sectional view illustrating another principal portion (second retaining means) of FIG. 18.

Next, referring now to FIG. 14 to FIG. 20, an embodiment of a printing plate unit automatic mounting apparatus (81) will be described. FIG. 14 is a front view of a printing plate unit automatic mounting apparatus (81) schematically illustrating a general configuration, FIG. 15 is a cross-sectional view illustrating an embodiment of a configuration of storage of the printing plate unit (1) in the printing plate unit automatic mounting apparatus (81), FIG. 16 is a partly broken front view illustrating one process of mounting of the printing plate unit (1) in the printing plate unit automatic mounting apparatus (81), FIG. 17 is a partly broken front view illustrating another process of mounting of the printing plate unit (1) in the printing plate unit automatic mounting apparatus (81), FIG. 18 is an enlarged lateral cross-sectional view taken along the line XVIII-XVIII in FIG. 17, and FIG. 19 is an enlarged lateral cross-sectional view illustrating a principal portion of FIG. 18. FIG. 20 is an enlarged lateral cross-sectional view illustrating another principal portion of FIG. 18.

As illustrated in FIG. 14, the printer includes a plurality (six in illustration) of plate cylinders (71) for printing different colors, a blanket cylinder (72) configured to be transferred with ink from the plate cylinder (71) and perform printing on a tin or the like, and an ink supply apparatus (73) configured to supply ink to the respective plate cylinders (71).

Each of the plate cylinders (71) is provided with the above-described printing plate mounting portion (2), and the printing plate (3) having a required plate portion (9) is mounted thereto, so that a multicolor printing is achieved.

In FIG. 14, the printing plate units (1) are arranged in a storage station (80) so that the projecting portions (11*a*) of the inner clamping member (11) come to above, so that mounting and demounting operation is performed by the printing plate unit automatic mounting apparatus (81).

The printing plate unit automatic mounting apparatus (81) includes a printing plate automatic mounting tool (83) provided on a robot arm (82) which is capable of moving in arbitrary directions.

The storage station (80) is provided with storage portions (84) configured to support the printing plate units (1) one by one, and the storage portions (84) each include an annular depression (85) in which a lower end portion (rear end portion at the time of being mounted) of the printing plate (3) of the printing plate unit (1) is accommodated as illustrated in FIG. 15, and a depression (86) having a substantially square shape in plan view provided so as to continue from the annular depression (85). The substantially square depression (86) accommodates the coupling member (4) of the printing plate unit (1) and a cylinder (87) configured to bias the coupling member (4) radially inward to fix the printing plate unit (1).

The printing plate automatic mounting tool (83) includes a housing (91) fixed to a distal end of the robot arm (82), a drive apparatus (retaining apparatus moving apparatus) (92) mounted on the housing (91), a movable body (93) mounted on a distal end of the drive apparatus (92), a first retaining means (94) and a second retaining means (printing plate unit retaining apparatus) (95) mounted on the movable body (93), and a pressing member (96) which constitutes the biasing apparatus pressing apparatus by being supported by the housing (91).

The drive apparatus (92) includes a fluid pressure cylinder (101), and is capable of moving a piston rod (102) in the axial direction of the piston rod (102).

The housing (91) is moved to the same axis as the printing plate mounting portion (2) of the plate cylinder (71) by the robot arm (82) being controlled in driving and is moved from this position to the rear side (proximal side in the axial direction of the plate drive shaft).

The movable body (93) is formed into a rectangular plate shape and is fixed to a distal end of the piston rod (102) so as to extend orthogonally to the axial direction of the piston rod (102).

The first retaining means (94) and the second retaining means (95) are provided on a surface on the rear side (distal end side) of the respective end portions of the movable body (93).

The first retaining means (94) retains a projecting portion (11*a*) of the inner clamping member (11), and includes two movable claws (103) (104) having a circular cross section (a plane orthogonal to the axial direction of the piston rod (102)), a movable claw (105) having a rectangular lateral cross-sectional surface, and a drive apparatus (106) configured to move these movable claws (103) (104) (105). The three movable claws (103) (104) (105) are disposed concentrically with respect to a center axis parallel to the axial direction of the piston rod (102), and are movable radially with respect to the center axis.

As illustrated in FIG. 19 in an enlarged scale, the inner clamping member (11) is formed to have a substantially T-shaped lateral cross section by the clamping portion (13) and the guide portion (14). One (103) of the movable claws having a circular lateral cross section is placed on a corner formed between a radially inside surface of the clamping portion (13) and a surface facing circumferentially one side of the guided portion (14), and the other movable claw (104) having a circular lateral cross section is placed on a corner formed between a radially inside surface of the clamping portion (13) and a surface facing circumferentially the other side of the guided portion (14). The movable claw (105) having a rectangular lateral cross section is placed on a surface radially outside of the clamping portion (13). Accordingly, the inner clamping member (11) is configured to be clamped from three directions in the radial direction by the three movable claws (103) (104) (105).

The second retaining means (95) retains a portion of the printing plate (3) located at a position 180 degrees apart from the position where the coupling member (4) is provided, and includes an inner movable claw (107) facing from the radially inside of an axis parallel to the axial direction of the piston rod (102), an outer movable claw (108) facing from the outside in the same radial direction, and a drive apparatus (109) of the movable claws (107) (108).

As illustrated in FIG. 20 in an enlarged scale, the inner movable claw (107) includes an annular opposed surface (107*a*) having a convex lateral cross section, and the outer movable claw (108) has an annular opposed surface (108*a*) having a depressed lateral cross section. The respective opposed surfaces (107*a*) (108*a*) have small projections (107*b*) (108*b*).

The opposed surface (107*a*) of the inner movable claw (107) is placed on the printing plate (3) from radially inside, and the opposed surface (108*a*) of the outer movable claw (108) is placed on the printing plate (3) from radially outside, whereby one circumferential portion of the printing plate (3) is retained between the opposed surfaces (107*a*) (108*a*) of the respective movable claws (107) (108).

The first retaining means (94) retains the inner clamping member (11), and the second retaining means (95) retains an end portion of the printing plate (3) at 180 degrees apart from the retained position, so that the printing plate unit (1) is retained.

The pressing member (96) has an elongated column shape, and a proximal end portion thereof is supported by the housing (91) and extends in parallel to the axial direction of the piston rod (102) penetrating through the movable body (93).

The pressing member (96) is capable of moving the inner slider (36) toward the side of the proximal end of the plate drive shaft in association with the movement of the housing (91) toward the side of the proximal end of the plate drive shaft as illustrated in FIG. 16 corresponding to FIG. 7 and FIG. 17 corresponding to FIG. 8. Accordingly, the function of the printing plate coupling member biasing apparatus (35) is lost. Therefore, when moving the printing plate unit (1) from a state illustrated in FIG. 17 to a state illustrated in FIG. 16, the printing plate coupling member biasing apparatus (35) does not hinder the movement, so that the printing plate unit (1) can be mounted and demounted easily with respect to the printing plate mounting portion (2). The pressing member (96) is preferably configured to be movable in the direction of the plate drive shaft with respect to the housing (91) in addition to the movement in association with the movement of the housing (91).

As described above, (as illustrated in FIG. 6 and FIG. 7), the circumferential thickness of the guided portion (14) of the inner clamping member (11) and the circumferential width of the guided portion fitting groove portions (30*a*) (30*b*) formed of a pair of guide members (30) configured to guide the guided portion (14) are not the same. The guided portion (14) includes a thin portion (14*a*), a thick portion (14*b*), and a tapered portion (14*c*), and the guided portion fitting groove portions (30*a*) (30*b*) include the wide guided portion fitting groove portion (30*a*) and the narrow guided portion fitting groove portion (30*b*), and a gap (G) exists between the thin portion (14*a*) of the guided portion (14) and the wide guided portion fitting groove portion (30*a*).

Therefore, when mounting the printing plate unit (1) on the printing plate mounting portion (2), first, the tapered portion (14*c*) at the distal end of the guided portion (14) enters the wide guided portion fitting groove portion (30*a*), and then the thin portion (14*a*) enters the wide guided portion fitting groove portion (30*a*). Here, the distal end of the guided portion (14) is tapered and a gap (G) exists between the thin portion (14*a*) of the guided portion (14) and the wide guided portion fitting groove portion (30*a*), so that insertion of the guided portion (14) into the guided portion fitting groove portions (30*a*) are not hindered even though a slight decentering exists between the guided portion (14) and the guided portion fitting groove portions (30*a*) (30*b*). Subsequently, the distal end portion of the thin portion (14*a*) of the guided portion (14) fits in the narrow guided portion fitting groove portion (30*b*) without rattling, and the thick portion (14*b*) of the guided portion (14) fits in the wide guided portion fitting groove portion (30*a*) without rattling, so that the coupling member (4) is fitted in a pair of guide members (30) of the printing plate coupling member accommodating groove (29) without rattling and slidably.

Since the gap (G) exists between the thin portion (14*a*) of the guided portion (14) and the wide guided portion fitting groove portion (30*a*), even though the printing plate unit automatic mounting apparatus (81) is used, insertion of the coupling member (4) into a pair of the guide members (30) are easily achieved.

FIG. 16 illustrates a state in which the movable body (93) is moved to the proximal side in the driving shaft direction to the maximum and, in this state, the second retaining means (95) retaining the printing plate (3) and the front end portion of the plate cylinder portion (7) may interfere with each other. However, since the depression (39) is formed at the front end portion of the plate cylinder portion (7), the interference is avoided.

According to the printing plate unit automatic mounting apparatus (81) of this embodiment, as descried above, the general purpose robot arm (82) is used and the printing plate automatic mounting tool (83) including the housing (91), the drive apparatus (92), the movable body (93), the first retaining means (94), the second retaining means (95), and the pressing member (96) are used, automatic mounting of the printing plate unit (1) which has not been achieved can be performed.

Configurations of the respective portions of the printing plate unit automatic mounting apparatus (81) are not limited to those described in conjunction with the above-described embodiments, and may be modified.

INDUSTRIAL APPLICABILITY

According to the invention, since a printing plate unit which facilitates automatic mounting of the plate cylinder apparatus for a printer on the printing plate mounting portion is achieved easily, the invention contributes to automation of the printer.

The invention claimed is:

1. A printing plate unit to be demountably mounted on a printing plate mounting portion of a plate cylinder comprising:

a printing plate having a plate portion provided on part of a surface of a sheet formed of a resilient material and engaging projecting ridges projecting on a rear surface side or a front surface side at both end portions in a longitudinal direction and extending in a width direction; and a printing plate coupling member coupling both end portions of the printing plate formed cylindrically in the longitudinal direction by engaging the both engaging projecting ridges of the printing plate formed cylindrically, wherein the printing plate coupling member is provided with a projecting portion projecting from the printing plate formed cylindrically in an axial direction and configured to serve as a gripping portion when being mounted and demounted with respect to the printing plate mounting portion, wherein the printing plate coupling member is provided with an inner clamping member and an outer clamping member configured to clamp both end portions of the printing plate formed cylindrically in the longitudinal direction from both inside and outside in a radial direction, and the projecting portion configured to serve as the gripping portion is provided on the inner clamping member, and wherein screw hole formed portions having a predetermined thickness are formed in the radial direction of the printing plate formed cylindrically at a plurality of positions on the inner clamping member, screw holes having a female screw are formed on the respective screw hole formed portions so as to penetrate the respective screw hole formed portions in the radial direction, screw insertion through holes which penetrate through the outer clamping member in the radial direction are formed at a plurality of positions on the outer clamping member corresponding to the screw holes, the plurality of clamping screw members are screwed into the screw holes so as to penetrate through the screw insertion through holes from the radially outward, retaining stoppers are provided at a distance radially inward from the screw hole formed portions of the clamping screw members projecting radially inward of the screw holes in a state in which the both clamping members are fixed by the clamping screw members, and permanent magnets are provided on the both clamping members in directions of interacting repulsively.

2. The printing plate unit according to claim 1, wherein the inner clamping member includes a clamping portion configured to clamp the printing plate; and a guided portion extending from the clamping portion radially inward of the printing plate formed cylindrically, a plurality of hole-shaped portions penetrating through the guided portion in the circumferential direction of the printing plate formed cylindrically are formed, and portions radially outward of the printing plate formed cylindrically from the hole-shaped portion correspond to the screw hole formed portions.

3. A plate cylinder apparatus for a printer comprising:

a printing plate unit according to claim 2; a plate drive shaft; and a printing plate mounting portion for mounting the printing plate unit to the plate drive shaft, wherein the printing plate mounting portion includes a cylindrical plate cylinder portion fixedly provided on the plate drive shaft and allows the printing plate unit to be mounted on an outer periphery thereof from a side of a distal end of the plate drive shaft, and the printing plate mounting portion further includes; a printing plate coupling member accommodating groove configured to accommodate the printing plate coupling member of the printing plate unit from the side of a distal end of the plate drive shaft, an axial direction positioning stopper portion to which a proximal end portion of the plate drive shaft of the printing plate coupling member is configured to abut, a printing plate coupling member guiding portion configured to guide the printing plate coupling member so as to be movable within a predetermined range in the radial direction of the plate cylinder portion, and a printing plate coupling member biasing apparatus configured to bias the printing plate coupling member radially outward of the plate cylinder portion.

4. A plate cylinder apparatus for a printer comprising:

a printing plate unit according to claim 1; a plate drive shaft; and a printing plate mounting portion for mounting the printing plate unit to the plate drive shaft, wherein the printing plate mounting portion includes a cylindrical plate cylinder portion fixedly provided on the plate drive shaft and allows the printing plate unit to be mounted on an outer periphery thereof from a side of a distal end of the plate drive shaft, and the printing plate mounting portion further includes; a printing plate coupling member accommodating groove configured to accommodate the printing plate coupling member of the printing plate unit from the side of a distal end of the plate drive shaft, an axial direction positioning stopper portion to which a proximal end portion of the plate drive shaft of the printing plate coupling member is configured to abut, a printing plate coupling member guiding portion configured to guide the printing plate coupling member so as to be movable within a predetermined range in the radial direction of the plate cylinder portion, and a printing plate coupling member biasing apparatus configured to bias the printing plate coupling member radially outward of the plate cylinder portion.

5. A plate cylinder apparatus for a printer comprising:

a printing plate unit to be demountably mounted on a printing plate mounting portion of a plate cylinder comprising:

a printing plate having a plate portion provided on part of a surface of a sheet formed of a resilient material and engaging projecting ridges projecting on a rear surface side or a front surface side at both end portions in a longitudinal direction and extending in a width direction; and a printing plate coupling member coupling both end portions of the printing plate formed cylindrically in the longitudinal direction by engaging the both engaging projecting ridges of the printing plate formed cylindrically, wherein the printing plate coupling member is provided with a projecting portion projecting from the printing plate formed cylindrically in an axial direction and configured to serve as a gripping portion when being mounted and demounted with respect to the printing plate mounting portion;

a plate drive shaft; and a printing plate mounting portion for mounting the printing plate unit to the plate drive shaft, wherein the printing plate mounting portion includes a cylindrical plate cylinder portion fixedly provided on the plate drive shaft and allows the printing plate unit to be mounted on an outer periphery thereof from a side of a distal end of the plate drive shaft, and the printing plate mounting portion further includes:

a printing plate coupling member accommodating groove configured to accommodate the printing plate coupling member of the printing plate unit from the side of a distal end of the plate drive shaft;

an axial direction positioning stopper portion to which a proximal end portion of the plate drive shaft of the printing plate coupling member is configured to abut;

a printing plate coupling member guiding portion configured to guide the printing plate coupling member so as to be movable within a predetermined range in the radial direction of the plate cylinder portion; and a printing plate coupling member biasing apparatus configured to bias the printing plate coupling member radially outward of the plate cylinder portion, wherein a depression configured to avoid interference between a printing plate unit retaining apparatus configured to retain the printing plate unit and the plate cylinder portion at the time of mounting and demounting of the printing plate unit at a position radially opposing the printing plate coupling member accommodating groove at an end portion of the distal end of the plate drive shaft of the plate cylinder portion.

6. A plate cylinder apparatus for a printer comprising:

a printing plate unit to be demountably mounted on a printing plate mounting portion of a plate cylinder comprising:

a printing plate having a plate portion provided on part of a surface of a sheet formed of a resilient material and engaging projecting ridges projecting on a rear surface side or a front surface side at both end portions in a longitudinal direction and extending in a width direction; and a printing plate coupling member coupling both end portions of the printing plate formed cylindrically in the longitudinal direction by engaging the both engaging projecting ridges of the printing plate formed cylindrically, wherein the printing plate coupling member is provided with a projecting portion projecting from the printing plate formed cylindrically in an axial direction and configured to serve as a gripping portion when being mounted and demounted with respect to the printing plate mounting portion;

a plate drive shaft; and a printing plate mounting portion for mounting the printing plate unit to the plate drive shaft, wherein the printing plate mounting portion includes a cylindrical plate cylinder portion fixedly provided on the plate drive shaft and allows the printing plate unit to be mounted on an outer periphery thereof from a side of a distal end of the plate drive shaft, and the printing plate mounting portion further includes:

a printing plate coupling member accommodating groove configured to accommodate the printing plate coupling member of the printing plate unit from the side of a distal end of the plate drive shaft;

an axial direction positioning stopper portion to which a proximal end portion of the plate drive shaft of the printing plate coupling member is configured to abut;

a printing plate coupling member guiding portion configured to guide the printing plate coupling member so as to be movable within a predetermined range in the radial direction of the plate cylinder portion; and a printing plate coupling member biasing apparatus configured to bias the printing plate coupling member radially outward of the plate cylinder portion, wherein the printing plate coupling member accommodating groove is formed on a groove formed surface provided on the outer periphery of the plate cylinder portion, the axial direction positioning stopper portion is provided at a proximal end portion of the plate drive shaft of the printing plate accommodating groove, the printing plate coupling member guiding portion is provided in the printing plate coupling member accommodating groove, and at least part of the printing plate coupling member biasing apparatus is provided at a biasing apparatus accommodating depression formed on a bottom of the printing plate coupling member accommodating groove.

7. The plate cylinder apparatus for a printer according to claim 6, wherein a pair of guide members which extends in the axial direction of the plate cylinder portion and constituting part of the printing plate coupling member guiding portion are provided so as to oppose each other on side walls of the printing plate coupling member accommodating groove opposing in the circumferential direction of the plate cylinder portion, an intermediate portion of the guided portion of the inner clamping member in the radial direction of the plate cylinder portion is interposed between the pair of guide members so as to slide in the axial direction and the radial direction of the plate cylinder portion, and part of the guided portion of the inner clamping member protruding from the pair of guide members radially inward of the plate cylinder portion is biased by the printing plate coupling member biasing apparatus.

8. The plate cylinder apparatus for a printer according to claim 7, wherein a movement restricting projection configured to prevent the radially outward movement of the inner clamping member by an abutment with the pair of guide members is provided at a portion of the guided portion of the inner clamping member protruding radially inward of the plate cylinder portion from the pair of guide members.

9. The plate cylinder apparatus for a printer according to claim 7, wherein the printing plate unit is the printing plate unit according to claim 6, and a wide guided portion fitting groove portion in which a thick portion of the guided portion fits without rattling and a narrow guided portion fitting groove portion in which a distal end portion of the guided portion fits without rattling are formed between the pair of guide members.

10. The plate cylinder apparatus for a printer according to claim 6, wherein the printing plate coupling member biasing apparatus includes an inner slider disposed so as to be capable of sliding over a predetermined range in the axial direction of the plate cylinder portion along a wall of the biasing apparatus accommodating depression, and having a wedge surface facing the side of the distal end of the plate drive shaft formed at a portion radially outside the plate cylinder portion, an outer slider disposed between the inner slider and the inner clamping member so as to be capable of sliding in a predetermined range in the radial direction of the plate cylinder portion along a wall of the biasing apparatus accommodating depression and provided with a wedge surface facing the proximal side of the plate drive shaft formed on a portion radially inside the plate cylinder portion so as to abut with the wedge surface of the inner slider; and a resilient member configured to bias the inner slider toward the distal end of the plate drive shaft, and a pressing member insertion opening which allows insertion of a pressing member configured to move the inner slider toward the side of the proximal end of the plate drive shaft against a biasing force of the resilient member is provided so as to face an end surface of the inner slider on the side of the distal end of the plate drive shaft.

11. The plate cylinder apparatus for a printer according to claim 10, wherein the inner slider and a wall of the biasing apparatus accommodating depression are brought into tight contact with each other by a magnetic attracting force of the permanent magnets, the outer slider and the wall of the biasing apparatus accommodating depression are brought into tight contact with each other by a magnetic attracting force of the permanent magnets, so that the wedge surfaces of the both inner and outer sliders are in tight contact with each other by a magnetic attracting force of the permanent magnets.

12. A printing plate unit automatic mounting apparatus for mounting and demounting a printing plate unit in the plate cylinder apparatus for the printer according to claim 10 with respect to a printing plate mounting portion comprising:

a pressing member inserted from the pressing member insertion opening and pressing an inner slider against a biasing force applied by the printing plate coupling member biasing apparatus, a printing plate unit retaining apparatus configured to retain and release the printing plate unit by retaining and releasing a projecting portion provided on the printing plate unit and configured to serve as the gripping portion; and a retaining apparatus moving apparatus configured to move the printing plate unit retaining apparatus in the axial direction of the plate drive shaft.

13. The printing plate unit automatic mounting apparatus according to claim 12, wherein the printing plate unit retaining apparatus includes first retaining means configured to retain and release a projecting portion which serves as the gripping portion, and second retaining means configured to retain and release the end portion on the side of the distal end of the plate drive shaft of the printing plate of the printing plate unit.

14. The printing plate unit automatic mounting apparatus according to claim 13, wherein the first retaining means is configured to retain the projecting portion of the inner clamping member from three directions by a first movable claw to be placed at a corner formed by a radially inside surface of the clamping portion and a surface facing one side in the circumferential direction of the guided portion, a second movable claw configured to be placed at a corner formed by a radially inside surface of the clamping portion and a surface facing the other side of the guided portion in the circumferential direction, and a third movable claw to be placed on a radially outside surface of the clamping portion.

15. The printing plate unit automatic mounting apparatus according to claim 13, wherein the second retaining means is configured to retain a portion of the printing plate at a position 180 degrees apart from the coupling member by an inner movable claw facing the printing plate from radially inside and an outer movable claw opposing the printing plate from the radially outside.

16. A printing plate unit automatic mounting apparatus for mounting and demounting a printing plate unit in a plate cylinder apparatus for a printer with respect to a printing plate mounting portion, the plate cylinder apparatus for a printer comprising:

a printing plate unit to be demountably mounted on a printing plate mounting portion of a plate cylinder comprising:

a printing plate having a plate portion provided on part of a surface of a sheet formed of a resilient material and engaging projecting ridges projecting on a rear surface side or a front surface side at both end portions in a longitudinal direction and extending in a width direction; and a printing plate coupling member coupling both end portions of the printing plate formed cylindrically in the longitudinal direction by engaging the both engaging projecting ridges of the printing plate formed cylindrically, wherein the printing plate coupling member is provided with a projecting portion projecting from the printing plate formed cylindrically in an axial direction and configured to serve as a gripping portion when being mounted and demounted with respect to the printing plate mounting portion;

a plate drive shaft; and a printing plate mounting portion for mounting the printing plate unit to the plate drive shaft, wherein the printing plate mounting portion includes a cylindrical plate cylinder portion fixedly provided on the plate drive shaft and allows the printing plate unit to be mounted on an outer periphery thereof from a side of a distal end of the plate drive shaft, and the printing plate mounting portion further includes:

a printing plate coupling member accommodating groove configured to accommodate the printing plate coupling member of the printing plate unit from the side of a distal end of the plate drive shaft;

an axial direction positioning stopper portion to which a proximal end portion of the plate drive shaft of the printing plate coupling member is configured to abut;

a printing plate coupling member guiding portion configured to guide the printing plate coupling member so as to be movable within a predetermined range in the radial direction of the plate cylinder portion; and a printing plate coupling member biasing apparatus configured to bias the printing plate coupling member radially outward of the plate cylinder portion, the printing plate unit automatic mounting apparatus comprising:

a biasing apparatus pressing apparatus capable of movable between a normal position not working against a biasing force applied by the printing plate coupling member biasing apparatus and an operating position for applying a counter biasing force with respect to the biasing force applied by the printing plate coupling member biasing apparatus;

a printing plate unit retaining apparatus configured to retain and release the printing plate unit by retaining and releasing a projecting portion provided on the printing plate unit and configured to serve as the gripping portion; and a retaining apparatus moving apparatus configured to move the printing plate unit retaining apparatus in the axial direction of the plate drive shaft.

* * * * *